US006186067B1

(12) United States Patent
Rorke et al.

(10) Patent No.: US 6,186,067 B1
(45) Date of Patent: Feb. 13, 2001

(54) INFRARED LASER-IMAGEABLE LITHOGRAPHIC PRINTING MEMBERS AND METHODS OF PREPARING AND IMAGING SUCH PRINTING MEMBERS

(75) Inventors: Thomas P. Rorke; Richard J. D'Amato, both of South Hadley; Timothy J. Dunley, Springfield, all of MA (US)

(73) Assignee: Presstek, Inc., Hudson, NH (US)

( * ) Notice: Under 35 U.S.C. 154(b), the term of this patent shall be extended for 0 days.

(21) Appl. No.: 09/410,230

(22) Filed: Sep. 30, 1999

(51) Int. Cl.[7] ..... B41C 1/10
(52) U.S. Cl. ..... 101/467; 101/457; 101/462
(58) Field of Search ..... 101/453, 454, 101/457, 458, 459, 460, 462, 463.1, 465, 466, 467; 430/302

(56) References Cited

U.S. PATENT DOCUMENTS 3,793,033 * 2/1974 Mukherjee ..... 101/456
4,617,250 * 10/1986 Nakakita et al. ..... 430/302
4,853,313 * 8/1989 Mori et al. ..... 430/303
5,188,032 * 2/1993 Lewis et al. ..... 101/453
5,353,705 * 10/1994 Lewis et al. ..... 101/453
5,493,971 * 2/1996 Lewis et al. ..... 101/454
5,605,780 * 2/1997 Burberry et al. ..... 430/278.1
5,919,600 * 7/1999 Huang et al. ..... 430/303
5,985,515 * 11/1999 Van Rompuy et al. ..... 101/457
5,996,498 * 12/1999 Lewis ..... 101/467
6,110,645 8/2000 DeBoer et al. ..... 430/302

* cited by examiner

*Primary Examiner*—Stephen R. Funk
(74) *Attorney, Agent, or Firm*—Testa, Hurwitz & Thibeault LLP

(57) ABSTRACT

Provided are methods of imaging a wet positive working lithographic printing member comprising the steps of providing a positive working printing member comprising a substrate, a hydrophilic layer, an infrared-absorbing layer, and, optionally, an ink-accepting surface layer; exposing the printing member to infrared radiation in an imagewise pattern removing by ablation greater than 10% by weight, and most preferably none of the infrared-absorbing layer and optional ink-accepting surface layer; and removing with water the laser-exposed areas of the infrared-absorbing layer and optional ink-accepting surface layer to reveal the underlying hydrophilic layer. These methods are advantageous in reducing airborne debris and vapors during laser imaging, in increasing the speed of laser imaging, and in providing excellent cleanability and image quality. The printing member may further comprise a primer layer underlying the infrared-absorbing layer with an adhesion-promoting agent present in the primer layer. Also provided are methods of preparing a wet lithographic printing member and wet positive working lithographic printing members prepared according to the methods of this invention.

25 Claims, 3 Drawing Sheets

INFRARED LASER-IMAGEABLE LITHOGRAPHIC PRINTING MEMBERS AND METHODS OF PREPARING AND IMAGING SUCH PRINTING MEMBERS

FIELD OF THE INVENTION

The present invention relates in general to lithography and more particularly to systems for preparing lithographic printing plates using digitally controlled laser output. More specifically, this invention relates to methods for preparing a lithographic printing plate especially suitable for directly imaging and utilizing with a wet lithographic printing press. The present invention also pertains to wet lithographic printing plates prepared according to such methods.

BACKGROUND OF THE INVENTION

Traditional techniques for introducing a printed image onto a recording material include letterpress printing and offset lithography. Both of these printing methods require a plate. To transfer ink in the pattern of the image, the plate is usually loaded onto a plate cylinder of a rotary press for efficiency. In letterpress printing, the image pattern is represented on the plate in the form of raised areas that accept ink and transfer it onto the recording medium by impression. The term "lithographic," as used herein, is meant to include various terms used synonymously, such as offset, offset lithographic, planographic, and others. By the term "wet lithographic," as used herein, is meant the type of lithographic printing plate where the printing is based upon the immiscibility of oil and water, wherein the oily material or ink is preferentially retained by the image area and the water or fountain solution is preferentially retained by the non-image area. When a suitably prepared surface is moistened with water and an ink is then applied, the background or non-image area retains the water and repels the ink while the image area accepts the ink and repels the water. The ink on the image area is then transferred to the surface of a material upon which the image is to be reproduced, such as paper, cloth, and 2 the like. Commonly the ink is transferred to an intermediate material called the blanket, which in turn transfers the ink to the surface of the material upon which the image is to be reproduced. In a dry lithographic printing system that does not utilize water, the plate is simply inked and the image transferred directly onto a recording material or transferred onto a blanket and then to the recording material.

Aluminum has been used for many years as a support for lithographic printing plates. In order to prepare the aluminum for such use, it is typically subject to both a graining process and a subsequent anodizing process. The graining process serves to improve the adhesion of the image to the plate and to enhance the water-receptive characteristics of the background areas of the printing plate. The graining and anodizing affect both the performance and the durability of the printing plate. Both mechanical and electrolytic graining processes are well known and widely used in the manufacture of lithographic printing plates. Processes for anodizing aluminum to form an anodic oxide coating and then hydrophilizing the anodized surface by techniques such as silication are also well known in the art, and need not be further described herein. The aluminum support is thus characterized by having a porous, wear-resistant hydrophilic surface, which specifically adapts it for use in lithographic printing, particularly where long press runs are required.

The plates for a lithographic press are usually produced photographically. The aluminum substrate described above is typically coated with a wide variety of photosensitive materials suitable for forming images for use in the lithographic printing process. Lithographic printing plates of this type are usually developed with an aqueous alkaline developing solution, which often additionally comprises a substantial quantity of an organic solvent.

To prepare a wet plate using a typical negative-working subtractive process, the original document is photographed to produce a photographic negative. This negative is placed on an aluminum plate having a water-receptive oxide surface coated with a photopolymer. Upon exposure to light or other radiation through the negative, the areas of the coating that received radiation (corresponding to the dark or printed areas of the original) cure to a durable oleophilic state. The plate is then subjected to a developing process that removes the uncured areas of the coating (i.e., those which did not receive radiation, corresponding to the non-image or background areas of the original), thereby exposing the hydrophilic surface of the aluminum plate.

Throughout this application, various publications, patents, and published patent applications are referred to by an identifying citation. The disclosures of the publications, patents, and published patent applications referenced in this application are hereby incorporated by reference into the present disclosure to more fully describe the state of the art to which this invention pertains.

As is evident from the above description, photographic platemaking processes tend to be time consuming and require facilities and equipment adequate to support the necessary chemistry. Efforts have been made for many years to manufacture a printing plate, which does not require aqueous alkaline or solvent development or which only uses water for development. In addition, practitioners have developed a number of electronic alternatives to plate imaging, some of which can be utilized on-press. With these systems, digitally controlled devices alter the ink-receptivity of blank plates in a pattern representative of the image to be printed. Such imaging devices include sources of electromagnetic radiation, produced by one or more laser or non-laser sources, that create physical and/or chemical changes on plate blanks; ink jet equipment that directly deposits ink-repellent or ink-accepting spots on plate blanks; and spark-discharge equipment, in which an electrode in contact with or spaced closely to a plate blank produces electrical sparks to physically alter the topology of the plate blank, thereby producing "dots" which collectively form a desired image as for example, described in U.S. Pat. No. 4,911,075. Because of the ready availability of laser equipment and its amenability to digital control, significant effort has been devoted to the development of laser-based imaging systems.

In one such system, argon-ion, frequency-doubled Nd-YAG, and other infrared lasers are used to expose photosensitive blanks for traditional chemical processing, as for example described in U.S. Pat. Nos. 3,506,779; 4,020,762; 4,868,092; 5,153,236; 5,372,915; and 5,629,354. In an alternative to this approach, a laser has been employed to selectively remove, in an imagewise pattern, an opaque coating that overlies a photosensitive plate blank. The plate is then exposed to a source of radiation, with the unremoved material acting as a mask that prevents radiation from reaching underlying portions of the plate, as for example described in U.S. Pat. No. 4,132,168. However, the need for high writing speeds, coupled with the constraint of the low-powered lasers favored by industry, has resulted in a requirement for printing plates that have a very high photosensitivity. Unfortunately, high photosensitivity almost always reduces the shelf life of these plates.

Another approach to laser imaging uses thermal-transfer materials, as for example described in U.S. Pat. Nos. 3,945,318; 3,962,513; 3,964,389; 4,395,946; and 5,395,729. With these systems, a polymer sheet transparent to the radiation emitted by the laser is coated with a transferable material. The transfer side of this construction is brought into contact with an acceptor sheet, and the transfer material is selectively irradiated through the transparent layer. Irradiation causes the transfer material to adhere preferentially to the acceptor sheet. The transfer and acceptor materials exhibit different affinities for fountain solution and/or ink, so that removal of the transparent polymer sheet with the unirradiated transfer material still on it leaves a suitably imaged, finished plate. Typically, the transfer material is oleophilic, and the acceptor material is hydrophilic. Plates produced with transfer type systems tend to exhibit short useful lifetimes due to the limited amount of material that can effectively be transferred. Airborne dirt can create an image quality problem depending on the particular construction. In addition, because the transfer process involves melting and resolidification of material, image quality further tends to be visibly poorer than that obtainable with other methods.

Other patents describe lithographic printing plates comprising a support and a hydrophilic imaging layer which, upon imagewise laser exposure, becomes oleophilic in the exposed areas while remaining hydrophilic in the unexposed areas, as for example disclosed in U.S. Pat. Nos. 3,793,033, 4,034,183; 4,081,572; and 4,693,958. However, these types of lithographic printing plates suffer from the lack of a sufficient degree of discrimination between oleophilic image areas and hydrophilic non-image areas, with the result that image quality on printing is poor.

Early examples utilizing lasers used the laser to etch away material from a plate blank to form an intaglio or letterpress pattern, as for example described in U.S. Pat. Nos. 3,506,779 and 4,347,785. This approach was later extended to production of lithographic plates, e.g., by removal of a hydrophilic surface to reveal an oleophobic underlayer, as for example described in U.S. Pat. No. 4,054,094. These early systems generally required high-power lasers, which are expensive and slow.

Other infrared laser ablation-based systems for imaging lithographic plates have been developed. These operate by laser-induced ablative removal of organic coating layers, which are coated onto a substrate such as a polyester/metal laminate or onto a polymer coating on a metal support. Use of these polyester or polymer coating materials between the ablation coating and the heat absorbing metal support provides a thermal barrier material which reduces the amount of laser energy required to ablate or fully remove the ablative-absorbing layer and any overlying surface layer, as for example described in Canadian Pat. No. 1,050,805 and in U.S. Pat. Nos. 5,339,737; and 5,353,705. The laser exposure thus removes one or more plate layers, resulting in an imagewise pattern of features on the plate. When the layers removed by laser ablation are the image regions that accept ink, the plates are negative working. When lasers with a large spot size are used for imaging a negative working plate, the size of the smallest printed dot is about as large as the spot size. Consequently, the image quality on printing may not be high. For example, a 35 micron laser spot size would print its smallest dot size at about 35 microns with a negative working plate. On a 200 lines per inch (1 pi) halftone screen, this is equivalent to a 5% to 6% dot.

U.S. Pat. No. 5,353,705 discloses a basic plate construction of a lithographic plate having a secondary ablation layer intermediate between a substrate and a surface layer, such as a hydrophilic metal substrate and a radiation-absorptive and ablatively absorbing surface layer. The secondary ablation layer performs the protective or thermal barrier function that shields the substrate from the thermal effects of imaging radiation. The secondary ablation or thermal barrier layer of the '705 patent is ablated only partially in response to ablation of the ablative-absorbing layer, is preferably substantially transparent to the laser radiation and thereby not characterized by ablative absorption of imaging radiation, and differs from the surface layer in its affinity for at least one printing fluid selected from the group consisting of ink and a fluid that repels ink, i.e., when the surface layer is ink-receptive and/or not receptive to a fountain solution, the thermal barrier layer is not ink-receptive and/or is receptive to a fountain solution, respectively. When the basic plate construction described in the '705 patent has an ink receptive surface layer, and the thermal barrier or secondary ablation layer is receptive to a fountain solution and thus is not ink receptive, a positive working, wet lithographic plate results since the portions not removed by ablation are the image regions that accept ink. Suitable polymeric materials for the secondary ablation layer of the '705 patent include, but are not limited to, polymethyl methacrylates, cellulosic ethers and esters, polyesters, and polyurethanes. Hexamethoxymethylmelamine with p-toluenesulfonic acid may be added to these polymeric materials.

U.S. Pat. No. 5,493,971 describes an example of such a positive working, wet lithographic plate. Its plate construction includes a hydrophilic metal substrate, a polymeric, hydrophilic protective or thermal barrier coating which also may serve as an adhesion-promoting primer, and an ink-accepting oleophilic surface layer characterized by ablative absorption of imaging radiation. The imaging laser interacts with the ablatable surface layer, causing ablation thereof. After laser ablation imaging which removes at least the surface layer and also at least some of the hydrophilic protective layer as shown in FIG. 2 of the '971 patent, the plate is then cleaned with a suitable solvent, e.g., water, to remove portions of the hydrophilic protective layer still remaining in the laser-exposed areas. Since the hydrophilic protective layer is partially ablated in the '971 patent, but is not characterized by ablative absorption of imaging radiation, this hydrophilic protective layer must not absorb the laser imaging radiation. It is thus similar to the secondary ablation layer of the '705 patent which is partially ablated and may be substantially transparent to the laser imaging radiation and thus not characterized by ablative absorption of the surface layer. In the '971 patent, depending on the solubility properties of the residual plug of the partially ablated hydrophilic protective layer in the cleaning solvent, e.g., water, the cleaning step reveals the hydrophilic protective coating at less than its original thickness, or reveals the hydrophilic metal substrate in the areas where the hydrophilic protective coating is entirely removed by the cleaning step. After cleaning, the plate behaves like a conventional positive working wet lithographic metal plate on the printing press.

However, adhesion of the remaining ink-accepting surface coating to the hydrophilic protective layer has proven a difficult problem to overcome. Loss of adhesion can result if the protective hydrophilic thermal barrier layer in the image or printing areas of the plate is damaged or degraded during the laser imaging and cleaning process of the '971 patent. For example, too much solvent or solubilization action by the cleaning solution or the fountain solution on press may erode the walls of the image areas, eliminating the underlying support provided by the hydrophilic barrier layer around the periphery of the image feature and degrading small image elements. This is particularly problematical when the hydrophilic protective coating layer is partially ablated and probably further removed by the cleaning step and the action of the fountain solution such that the original surface of this protective coating layer is removed. This fully exposes the interface between the ink-accepting layer and the hydrophilic protective coating layer, as well as some of the wall of the hydrophilic protective coating layer at the edge of the image feature, to these wet cleaning and fountain solutions. This may lead to a major loss of image quality. Small dots and type may be removed during the cleaning step or early in the print run. Efforts to improve the adhesion of the laser ablatable surface coating and/or its durability to permit longer printing runs typically leads to a significant increase in the laser energy required to image the plate. International Publication No. WO 99/37481 discloses novel positive working, wet lithographic printing plates and methods for preparing such lithographic printing plates, which overcome this adhesion problem.

U.S. Pat. No. 5,605,780 describes a laser-ablatable lithographic printing plate comprising an anodized aluminum support having thereon an oleophilic image-forming layer comprising an infrared-absorbing agent dispersed in a film-forming cyanoacrylate polymer binder. The hydrophilic protective layer has been eliminated. The '780 patent describes low required laser energy, good ink receptivity, good adhesion to the support, and good wear characteristics. Print runs of more than 8200 impressions are shown in the examples.

U.S. Pat. No. 5,339,737 and Reissue Pat. No. 35,512 describe a variety of ablation-type lithographic plate configurations for use with laser diode imaging apparatus. These configurations include an ablation layer, which volatilizes into gaseous and particulate debris in response to infrared imaging radiation. As used herein, the term "ablation" refers to the volatilization of a layer or a material into gaseous and particulate debris in response to imaging radiation, which ablation results in a loss of mass or weight in the layer or material. For example, U.S. Pat. No. 5,493,971 describes a complete or 100% ablative loss of the ablative layer during the laser ablation imaging process, and FIG. 3A of International Publication No. WO 99/37481 describes a partial ablative loss of about 50% or greater of the ablatable layer during the laser ablation imaging process.

Lithographic printing members are now commonly imaged by lower-power laser ablation imaging mechanisms. A major problem with these infrared laser ablation-based systems for imaging lithographic plates has been environmental. Because these operate by laser-induced destruction or removal of organic polymers and other organic or inorganic materials which are coated in one or more layers overlying a substrate, airborne debris and vapors are produced during imaging which may be hazardous to the laser equipment and to the personnel who operate the equipment. Expensive equipment is generally required to contain the debris and to capture the gases.

Despite the many efforts directed to the development of a laser imageable wet lithographic printing plate, there still remains a need for plates that require no alkaline or solvent developing solution, that perform like a conventional lithographic printing plate on press, that are sensitive to a broad spectrum of laser energy such as 700 nm to 1150 nm, that provide a high resolution and durable image, and that do not produce debris and vapor requiring expensive and complex containment equipment.

SUMMARY OF THE INVENTION

One aspect of the present invention pertains to methods of imaging a wet lithographic printing member, which methods comprise the steps of (a) providing a positive working lithographic printing member, which positive working member comprises a substrate, a hydrophilic layer overlying the substrate, and an ink-accepting and infrared-absorbing surface layer overlying the hydrophilic layer; wherein the surface layer is characterized by absorption of infrared imaging radiation, by being not removable by cleaning with water or a cleaning solution prior to the absorption of infrared imaging radiation, and by being adapted to form a wet lithographic printing surface as a result of an imagewise exposure to absorbable infrared radiation and subsequent removal of the exposed areas of the surface layer by cleaning with water or the cleaning solution to reveal the underlying hydrophilic layer; and the hydrophilic layer is characterized by being not removable by cleaning with water or the cleaning solution; (b) exposing the positive working member of step (a) to absorbable infrared radiation using an infrared-emitting laser to effect absorption of infrared radiation in the laser-exposed areas of the surface layer that is sufficient to cause the surface layer in the laser-exposed areas to become removable by cleaning with water or the cleaning solution but insufficient to remove by ablation greater than 10% by weight of the surface layer material in the laser-exposed areas; and (c) removing, with water or the cleaning solution, the laser-exposed areas of the surface layer to reveal the underlying hydrophilic layer. In one embodiment of the methods, the hydrophilic layer is characterized by the absence of removal of the hydrophilic layer in the laser-exposed areas during steps (b) and (c). In a p referred embodiment , the absorption of infrared radiation in the laser-exposed areas of the surface layer of step (b) is sufficient to cause the surface layer in the laser-exposed areas to become removable by cleaning with water or the cleaning solution but insufficient to remove by ablation greater than 5% by weight, more preferably greater than 2% by weight, and most preferably none, of the surface layer in the laser-exposed areas. Thus, the methods of this invention provide a wet lithographic printing member with a very low or zero level of emission of gases and airborne debris during laser imaging, while also achieving excellent cleanability of the laser-exposed areas by water or an equivalent environmentally-acceptable aqueous solution and excellent image resolution and durability due to the properties of the infrared-absorbing and hydrophilic layers and their interface, as described herein.

Another aspect of the methods of imaging a wet lithographic printing member of this invention pertains to the inclusion of a primer layer interposed between the hydrophilic layer and the infrared-absorbing layer to further enhance the desirable properties of the infrared-absorbing and hydrophilic layers and their interface which greatly influence the amount of airborne materials produced during laser imaging, the speed of laser imaging, the ease of cleanability by water during removal of the laser-exposed areas, and the image resolution and durability, as described herein. In one embodiment of the methods, a primer layer is interposed between the hydrophilic layer and the surface layer in step (a) of the methods of this invention described hereinabove, which primer layer comprises an adhesion-promoting agent. In one embodiment, the thickness of the primer layer of step (a) is from 0.01 to 0.1 microns. In one embodiment, the adhesion-promoting agent of the primer layer comprises a crosslinked, polymeric reaction product of a hydrophilic polymer and a crosslinking agent, and preferably, further comprises a catalyst. In one embodiment, the primer layer comprises an organic sulfonic acid component. In one embodiment, the primer layer comprises a zirconium compound.

The term "printing member," as used herein, is synonymous with the term "plate" and pertains to any type of printing member or surface capable of recording an image defined by regions exhibiting differential affinities for ink and/or fountain solution. The term "cleaning solution," as used herein, pertains to a solution used to clean or remove the coating or coatings from the laser-exposed regions of the print members of the methods of this invention and may be water, combinations of at least 90% water and 10% or less organic solvents and additives such as alcohols, surfactants, and glycols, and buffered or salt-containing neutral or nearly neutral water solutions, such as known in the art of aqueous fountain solutions for wet lithographic printing. The term "cleaning solution," as used herein, does not include alkaline aqueous solutions with a pH of greater than about 10, acidic aqueous solutions with a pH of less than about 3.5, or organic solvents without at least 90% by weight of water present. In a preferred embodiment, the surface layer in the areas not exposed by the laser is further characterized by being not removable by cleaning with water or a cleaning solution and by durability on a wet lithographic printing press.

In one embodiment, the weight of the infrared-absorbing layer of the printing members of the methods of this invention is from about 0.05 to about 1.0 g/m$^2$. In a referred embodiment, the weight of the infrared-absorbing layer is from about 0.1 to about 0.5/m$^2$.

In one embodiment of the methods of this invention, the infrared-absorbing layer, which is the surface layer in a two layer plate construction of a hydrophilic layer and an infrared-absorbing layer on a substrate, comprises one or more polymers and an infrared-absorbing sensitizer. In one embodiment, the infrared-absorbing sensitizer is a carbon black. In one embodiment, the infrared-absorbing layer comprises one or more carbon blacks selected from the group consisting of: sulfonated carbon blacks having sulfonated groups on the surface of the carbon black, carboxylated carbon blacks having carboxyl groups on the surface of the carbon black, and carbon blacks having a surface active hydrogen content of not less than 1.5 mmol/g. In a preferred embodiment, the infrared-absorbing sensitizer is CAB-O-JET 200. In another preferred embodiment, the infrared-absorbing sensitizer is BONJET BLACK CW-1. In one embodiment, the infrared-absorbing sensitizer is present in an amount greater than 55% by weight of the infrared-absorbing layer. In one embodiment, the infrared-absorbing sensitzer is present in an amount greater than 65% by weight of the infrared-absorbing layer.

In one embodiment of the methods of this invention, one of the one or more polymers of the infrared-absorbing layer comprises a polymer selected from the group consisting of: polyvinyl alcohols, polyurethanes, epoxy polymers, vinyl polymers, acrylic polymers, and cellulosics. In one embodiment, the infrared-absorbing layer comprises a polyvinyl alcohol. In one embodiment, the polyvinyl alcohol is present in an amount of 20 to 95 per cent by weight of the total weight of polymers present in the infrared-absorbing layer. As used herein, for the purposes of determining the weight per cent of a material, the term "polymers" includes all the materials which are polymeric film formers, including monomeric species which polymerize or combine with a polymeric species, such as, for example, a monomeric crosslinking agent. In one embodiment, the polyvinyl alcohol is present in an amount of 25 to 75 per cent by weight of the total weight of polymers present in the infrared-absorbing layer. Suitable polymers for use in combination with polyvinyl alcohol in the infrared-absorbing layer include, but are not limited to other water-soluble or water-dispersible polymers such as, for example, polyurethanes, cellulosics, epoxy polymers, acrylic polymers, and vinyl polymers.

In one embodiment of the methods of the present invention, the infrared-absorbing layer comprises a crosslinking agent, preferably a melamine. In one embodiment, one or more polymers of the infrared-absorbing layer comprise a crosslinked, polymeric reaction product of a polymer and a crosslinking agent. In a preferred embodiment, the crosslinked, polymeric reaction product is selected from the group consisting of crosslinked reaction products of a crosslinking agent with the following polymers: a polyvinyl alcohol; a polyvinyl alcohol and a vinyl polymer; a cellulosic polymer; a polyurethane; an epoxy polymer; an acrylic polymer; and a vinyl polymer.

In one embodiment of the methods of the present invention, the infrared-absorbing layer further comprises a catalyst in addition to one or more polymers and an infrared-absorbing sensitizer.

In one embodiment of the methods of this invention, the infrared-absorbing layer comprises one or more polymers, an infrared-absorbing sensitizer, and an organic sulfonic acid component, preferably a component of an amine-blocked p-toluenesulfonic acid. In one embodiment, the organic sulfonic acid component is present in an amount of 25 to 75 weight per cent of the total weight of polymers present in the infrared-absorbing layer of the printing members of the methods of the present invention. In another embodiment, the organic sulfonic acid component is present in an amount of 35 to 55 weight per cent of the total weight of polymers present in the infrared-absorbing layer. In one embodiment, the infrared-absorbing layer comprises greater than 5% by weight of the organic sulfonic acid component. In one embodiment, the infrared-absorbing layer comprises greater than 12% by weight of the organic sulfonic acid component.

In one embodiment of the methods of preparing a wet lithographic printing member of the present invention, the hydrophilic layer comprises a crosslinked, polymeric reaction product of a hydrophilic polymer and a first crosslinking agent. Suitable hydrophilic polymers for the crosslinked, polymeric reaction product include, but are not limited to, polyvinyl alcohols and cellulosics. In a preferred embodiment, the hydrophilic polymer is a polyvinyl alcohol. In one embodiment, the first crosslinking agent is a zirconium compound. In one embodiment, the first crosslinking agent is ammonium zirconyl carbonate. In a preferred embodiment, the first crosslinking agent is ammonium zirconyl carbonate, and the ammonium zirconyl carbonate is present in an amount greater than 10% by weight of the polyvinyl alcohol, and, more preferably, present in an amount of 20 to 50% by weight of the polyvinyl alcohol. In another preferred embodiment, the hydrophilic layer further comprises a second crosslinking agent. In one embodiment, the hydrophilic layer further comprises a crosslinked, polymeric reaction product of a polyvinyl alcohol and the second crosslinking agent. In one embodiment, the second crosslinking agent is a melamine. In one embodiment, the hydrophilic layer further comprises a catalyst for the second crosslinking agent. In one embodiment, the catalyst is an organic sulfonic acid component. In one embodiment, the hydrophilic layer comprises an inorganic xerogel layer, which xerogel layer preferably comprises a zirconium oxide xerogel.

In one embodiment of the printing members of the methods of the present invention, the thickness of the hydrophilic layer is from about 1 to about 40 microns. In one embodiment, the thickness of the hydrophilic layer is from about 2 to about 25 microns.

In one embodiment of the printing members of the methods of preparing a wet lithographic printing plate member of this invention, suitable substrates comprise non-metal substrates and non-hydrophilic substrates, preferably papers, polymeric films, and non-hydrophilic metals such as non-hydrophilic aluminum. In one embodiment, the substrate is selected from the group of polymeric films consisting of: polyesters, polycarbonates, and polystyrene. In one embodiment, the polyester polymeric film is a polyethylene terephthalate film. In one embodiment, the non-hydrophilic metal substrate comprises a non-hydrophilic polymer layer on at least one surface of the non-hydrophilic metal substrate. In one embodiment, the substrate is a hydrophilic metal. Suitable metals for the hydrophilic metal substrate include, but are not limited to, aluminum, copper, steel, and chromium. In a preferred embodiment, the metal substrate is grained, anodized, silicated, or a combination thereof. In one embodiment, the metal substrate is aluminum. In a preferred embodiment, the metal substrate is an aluminum substrate comprising a surface of uniform, non-directional roughness and microscopic depressions, which surface is in contact to the hydrophilic layer and, more preferably, this surface of the aluminum substrate has a peak count in the range of 300 to 450 peaks per linear inch which extend above and below a total bandwidth of 20 microinches.

Another aspect of the present invention pertains to methods of preparing a wet lithographic printing member, which methods comprise the steps of (a) coating onto a substrate a liquid mixture comprising a first liquid medium, a hydrophilic polymer, and a first crosslinking agent; (b) drying the layer formed in step (a) to remove the first liquid medium, to cause a portion of the first crosslinking agent present to react, and to form a hydrophilic layer; (c) coating onto the hydrophilic layer a liquid mixture comprising a second liquid medium, a polymer, an infrared-absorbing sensitizer, and a second crosslinking agent; (d) drying the layer formed in step (c) to remove the second liquid medium, to cause an additional portion of the first crosslinking agent present in the hydrophilic layer to react, to cause a portion of the second crosslinking agent present to react, and to form an ink-accepting and infrared-absorbing surface layer; thereby forming a positive working lithographic printing member, wherein the surface layer and the hydrophilic layer are characterized by being not removable by cleaning with water or a cleaning solution; (e) exposing the positive working member of step (d) to absorbable infrared radiation using an infrared-emitting laser to effect absorption of infrared radiation in the laser-exposed areas of the surface layer that is sufficient to cause the surface layer in the laser-exposed areas to become removable by cleaning with water or the cleaning solution but insufficient to remove by ablation greater than 10% by weight of the surface layer in the laser-exposed areas; and (f) removing, with water or the cleaning solution, the laser-exposed areas of the surface layer to reveal the underlying hydrophilic layer. In one embodiment of the methods, subsequent to step (b) and prior to step (c), there are two steps of (i) coating onto the hydrophilic layer a liquid mixture comprising a liquid medium and an adhesion-promoting agent; and (ii) drying the layer formed in step (i) to remove the liquid medium of step (i) and to form a primer layer; and step (c) then comprises coating onto the primer layer the liquid mixture comprising a second liquid medium, a polymer, an infrared-absorbing sensitizer, and a second crosslinking agent. In one embodiment of the methods, the hydrophilic layer is characterized by the absence of removal of the hydrophilic layer in the laser-exposed areas during steps (e) and (f). In a preferred embodiment, the absorption of infrared radiation in the laser-exposed areas of step (e) is sufficient to cause the surface layer in the laser-exposed areas to become removable by cleaning with water or the cleaning solution but insufficient to remove by ablation greater than 5% by weight, more preferably greater than 2% by weight, and most preferably none, of the surface layer in the laser-exposed areas. In one embodiment, the weight of the infrared-absorbing layer of the printing members of the methods of this invention is from about 0.05 to about 1.0 $g/m^2$. In a preferred embodiment, the weight of the infrared-absorbing layer is from about 0.1 to about 0.5 $g/m^2$.

Another aspect of the present invention pertains to methods of preparing a wet lithographic printing member, which methods comprise the steps of: (a) coating onto a substrate a liquid mixture comprising a first liquid medium, a hydrophilic polymer, and a first crosslinking agent; (b) drying the layer formed in step (a) to remove the first liquid medium and to form a hydrophilic layer; (c) coating onto the hydrophilic layer a liquid mixture comprising a second liquid medium, a polymer, an infrared-absorbing sensitizer, and a second crosslinking agent; wherein a portion of the second crosslinking agent penetrates into the hydrophilic layer; (d) drying the layer formed in step (c) and the underlying hydrophilic layer to remove the second liquid medium, to cause a portion of the second crosslinking agent present in the hydrophilic layer to react, and to form an ink-accepting and infrared-absorbing surface layer; thereby forming a positive working lithographic printing member, wherein the surface layer and the hydrophilic layer are characterized by being not removable by cleaning with water or a cleaning solution; (e) exposing the positive working member of step (d) to absorbable infrared radiation using an infrared-emitting laser to effect absorption of infrared radiation in the laser-exposed areas of the surface layer that is sufficient to cause the surface layer in the laser-exposed areas to become removable by cleaning with water or the cleaning solution but insufficient to remove by ablation greater than 10% by weight of the surface layer in the laser-exposed areas; and (f) removing, with water or the cleaning solution, the laser-exposed areas of the surface layer to reveal the underlying hydrophilic layer. In one embodiment of the methods, subsequent to step (b) and prior to step (c), there are two steps of (i) coating onto the hydrophilic layer a liquid mixture comprising a liquid medium and an adhesion-promoting agent; and (ii) drying the layer formed in step (i) to remove the liquid medium of step (i) and to form a primer layer; and step (c) then comprises coating onto the primer layer the liquid mixture comprising a second liquid medium, a polymer, an infrared-absorbing sensitizer, and a second crosslinking agent. In one embodiment of the methods, the hydrophilic layer is characterized by the absence of removal of the hydrophilic layer in the laser-exposed areas during steps (e) and (f). In a preferred embodiment, the absorption of infrared radiation in the laser-exposed areas of the surface layer of step (e) is sufficient to cause the surface layer in the laser-exposed areas to become removable by cleaning with water or the cleaning solution but insufficient to remove by ablation greater than 5% by weight, more preferably greater than 2% by weight, and most preferably none, of the surface layer in the laser-exposed areas. In one embodiment, the weight of the infrared-absorbing layer is from about 0.05 to about 1.0 $g/m^2$. In a preferred embodiment, the weight of the infrared-absorbing layer is from about 0.1 to about 0.5 $g/m^2$.

Still another aspect of this invention pertains to methods of preparing a wet lithographic printing member, which methods comprise the steps of: (a) coating onto a substrate a liquid mixture comprising a first liquid medium, one or more hydrophilic polymers, and a first crosslinking agent, wherein the first crosslinking agent is present in an amount greater than 10% by weight of the one or more hydrophilic polymers; (b) drying the layer formed in step (a) to remove the first liquid medium and to form a hydrophilic layer; (c) coating onto the hydrophilic layer a liquid mixture comprising a second liquid medium, a polymer, an infrared-absorbing sensitizer, and a second crosslinking agent; (d) drying the layer formed in step (c) to remove the second liquid medium and to form an ink-accepting and infrared-absorbing surface layer, wherein the sensitizer is present in an amount of 25 to 80% by weight of the surface layer, and the one or more polymers are present in an amount of 10 to 60% by weight of the surface layer; thereby forming a positive working lithographic printing member, wherein the surface layer and the hydrophilic layer are characterized by being not removable by cleaning with water or a cleaning solution; (e) exposing the positive working member of step (d) to absorbable infrared radiation using an infrared-emitting laser to effect absorption of infrared radiation in the laser-exposed areas of the surface layer that is sufficient to cause the surface layer in the laser-exposed areas to become removable by cleaning with water or the cleaning solution but insufficient to remove by ablation greater than 10% by weight of the surface layer in the laser-exposed areas; and (f) removing, with water or the cleaning solution, the laser-exposed areas of the surface layer to reveal the underlying hydrophilic layer. In one embodiment of the methods, the hydrophilic layer is characterized by the absence of removal of the hydrophilic layer in the laser-exposed areas during steps (e) and (f). In a preferred embodiment, the absorption of infrared radiation in the laser-exposed areas of the surface layer of step (b) is sufficient to cause the surface layer in the laser-exposed areas to become removable by cleaning with water or the cleaning solution but insufficient to remove by ablation greater than 5% by weight, more preferably greater than 2% by weight, and most preferably none, of the surface layer in the laser-exposed areas. In one embodiment, the weight of the infrared-absorbing surface layer is from about 0.05 to about 1.0 g/m$^2$. In one embodiment, the weight of the infrared-absorbing surface layer is from about 0.1 to about 0.5 g/m$^2$. Suitable polymers for forming the ink-accepting and infrared-absorbing layer of steps (c) and (d) include, but are not limited to, polyvinyl alcohols, polyurethanes, epoxy polymers, vinyl polymers, acrylic polymers, and cellulosics.

Another aspect of the methods of imaging a wet lithographic printing member of the present invention pertains to the inclusion of an additional ink-accepting surface layer overlying the infrared-absorbing layer to provide a basic three layer product design of ink-accepting surface layer/infrared-absorbing layer/hydrophilic layer on the substrate. This additional ink-accepting surface layer may be useful in achieving the best overall balance of properties, such as increasing the speed of laser imaging, the ease of cleanability by water during removal of the laser-exposed areas, and particularly the image resolution and durability. In one embodiment, the method of imaging a wet lithographic printing member comprises the steps of (a) providing a positive working lithographic printing member, which positive working member comprises a substrate, a hydrophilic layer overlying the substrate, an infrared-absorbing layer overlying the hydrophilic layer, and an ink-accepting surface layer overlying the infrared-absorbing layer; the surface layer being characterized by the absence of ablation from absorption of infrared imaging radiation; the infrared-absorbing layer being characterized by absorption of imaging radiation; the surface layer and the infrared-absorbing layer being characterized by being not removable by cleaning with water or a cleaning solution prior to the absorption of infrared imaging radiation and by being adapted to form a wet lithographic printing surface as a result of an image-wise exposure to absorbable infrared radiation and subsequent removal of the exposed areas of the surface layer and the infrared-absorbing layer by cleaning with water or the cleaning solution to reveal the underlying hydrophilic layer; and the hydrophilic layer being characterized by being not removable by cleaning with water or the cleaning solution; (b) exposing the positive working member of step (a) to absorbable infrared radiation using an infrared-emitting laser to effect absorption of infrared radiation in the laser-exposed areas of the infrared-absorbing layer that is sufficient to cause the surface layer and the infrared-absorbing layer in the laser-exposed areas to become removable by cleaning with water or the cleaning solution but insufficient to remove by ablation greater than 10% by weight of the combined surface layer and infrared-absorbing layer in the laser-exposed areas; and (c) removing, with water or the cleaning solution, the laser-exposed areas of the surface layer and the infrared-absorbing layer to reveal the underlying hydrophilic layer.

Another aspect of the methods of imaging a wet lithographic printing member with a basic three layer product design of this invention pertains to the inclusion of a primer layer interposed between the hydrophilic layer and the infrared-absorbing layer to further enhance the desirable properties of the infrared-absorbing and hydrophilic layers and their interface which greatly influence the amount of airborne materials produced during laser imaging, the speed of laser imaging, the ease of cleanability by water during removal of the laser-exposed areas, and the image resolution and durability, as described herein. In one embodiment of the methods, a primer layer is interposed between the hydrophilic layer and the infrared-absorbing layer in step (a) of the methods, which primer layer comprises an adhesion-promoting agent. In one embodiment, the thickness of the primer layer of step (a) is from 0.01 to 0.1 microns. In one embodiment, the adhesion-promoting agent of the primer layer comprises a crosslinked, polymeric reaction product of a hydrophilic polymer and a crosslinking agent, and preferably, further comprises a catalyst. In one embodiment, the primer layer comprises an organic sulfonic acid component. In one embodiment, the primer layer comprises a zirconium compound.

In one embodiment of the methods of imaging a wet lithographic printing member with a three-layer product design with optional primer layer of this invention, the ink-accepting surface layer comprises a crosslinked, polymeric reaction product of a polymer and a crosslinking agent. Suitable polymers for the crosslinked, polymeric reaction product includes, but are not limited to, cellulosics, acrylic polymers, polyurethanes, and epoxy polymers. In one embodiment, the ink-accepting surface layer further comprises an organic sulfonic acid component. In one embodiment, the weight of the ink-accepting surface layer is from about 0.05 to about 0.5 g/m$^2$. In a preferred embodiment, the weight of the ink-accepting surface layer is from about 0.1 to about 0.3 g/m$^2$. In one embodiment of the methods, the hydrophilic layer is characterized by the absence of removal of the hydrophilic layer in the laser-exposed areas during steps (b) and (c). In a preferred embodiment, the absorption of infrared radiation in the laser-exposed areas of the infrared-absorbing layer of step (b) is sufficient to cause the ink-accepting surface layer and the infrared-absorbing layer in the laser-exposed areas to become removable by cleaning with water or the cleaning solution but insufficient to remove by ablation greater than 5% by weight, more preferably greater than 2% by weight, and most preferably none, of the combined ink-accepting surface layer and infrared-absorbing layer in the laser-exposed areas.

Another aspect of the present invention pertains to methods of preparing a wet lithographic printing member with a basic three layer product design, which methods comprise the steps of (a) coating onto a substrate a liquid mixture comprising a first liquid medium, a hydrophilic polymer, and a first crosslinking agent; (b) drying the layer formed in step (a) to remove the first liquid medium, to cause a portion of the first crosslinking agent present to react, and to form a hydrophilic layer; (c) coating onto the hydrophilic layer a liquid mixture comprising a second liquid medium, a polymer, an infrared-absorbing sensitizer, and a second crosslinking agent; (d) drying the layer formed in step (c) to remove the second liquid medium, to cause an additional portion of the first crosslinking agent present in the hydrophilic layer to react, to cause a portion of the second crosslinking agent present to react, and to form an infrared-absorbing layer; (e) coating onto the infrared-absorbing layer a liquid mixture comprising a third liquid medium and an ink-accepting polymer; (f) drying the layer formed in step (e) to remove the third liquid medium and to form an ink-accepting surface layer; thereby forming a positive working wet lithographic printing member, wherein the surface layer, the infrared-absorbing layer, and the hydrophilic layer are characterized by being not removable by cleaning with water or a cleaning solution; (g) exposing the positive working member of step (f) to absorbable infrared radiation using an infrared-emitting laser to effect absorption of infrared radiation in the laser-exposed areas of the infrared-absorbing layer that is sufficient to cause the surface layer and the infrared-absorbing layer in the laser-exposed areas to become removable by cleaning with water or the cleaning solution but insufficient to remove by ablation greater than 10% by weight of the combined surface layer and infrared-absorbing layer in the laser-exposed areas; and (h) removing, with water or the cleaning solution, the laser-exposed areas of the surface and infrared-absorbing layers to reveal the underlying hydrophilic layer. In one embodiment of the methods, subsequent to step (b) and prior to step (c), there are two steps of (i) coating onto the hydrophilic layer a liquid mixture comprising a liquid medium and an adhesion-promoting agent; and (ii) drying the layer formed in step (i) to remove the liquid medium of step (i) and to form a primer layer; and step (c) then comprises coating onto the primer layer the liquid mixture comprising a second liquid medium, a polymer, an infrared-absorbing sensitizer, and a second crosslinking agent.

Still another aspect of the methods of preparing a wet lithographic printing member having a three layer product design of this invention pertains to methods comprising the steps of (a) coating onto a substrate a liquid mixture comprising a first liquid medium, a hydrophilic polymer, and a first crosslinking agent; (b) drying the layer formed in step (a) to remove the first liquid medium and to form a hydrophilic layer; (c) coating onto the hydrophilic layer a liquid mixture comprising a second liquid medium, a polymer, an infrared-absorbing sensitizer, and a second crosslinking agent; wherein a portion of the second crosslinking agent penetrates into the hydrophilic layer; (d) drying the layer formed in step (c) and the underlying hydrophilic layer to remove the second liquid medium, to cause a portion of the second crosslinking agent present in the hydrophilic layer to react, and to form an infrared-absorbing layer; (e) coating onto the infrared-absorbing layer a liquid mixture comprising a third liquid medium and an ink-accepting polymer; (f) drying the layer formed in step (e) to remove the third liquid medium and to form an ink-accepting surface layer; thereby forming a positive working wet lithographic printing member, wherein the surface layer, the infrared-absorbing layer, and the hydrophilic layer are characterized by being not removable by cleaning with water or a cleaning solution; (g) exposing the positive working member of step (f) to absorbable infrared radiation using an infrared-emitting laser to effect absorption of infrared radiation in the laser-exposed areas of the infrared-absorbing layer that is sufficient to cause the surface and infrared-absorbing layers in the laser-exposed areas to become removable by cleaning with water or the cleaning solution but insufficient to remove by ablation greater than 10% by weight of the combined surface layer and infrared-absorbing layer in the laser-exposed areas; and (h) removing, with water or the cleaning solution, the laser-exposed areas of the surface and infrared-absorbing layers to reveal the underlying hydrophilic layer. In one embodiment of the methods, subsequent to step (b) and prior to step (c), there are two steps of (i) coating onto the hydrophilic layer a liquid mixture comprising a liquid medium and an adhesion-promoting agent; and (ii) drying the layer formed in step (i) to remove the liquid medium of step (i) and to form a primer layer; and step (c) then comprises coating onto the primer layer the liquid mixture comprising a second liquid medium, a polymer, an infrared-absorbing sensitizer, and a second crosslinking agent.

In one embodiment, the infrared-absorbing layer of the three layer designs of the printing members of the methods of the present invention is ink-accepting. In one embodiment, the infrared-absorbing layer of the three layer designs of the printing members of the methods of the present invention is further characterized by not accepting ink and by accepting water on a wet lithographic printing press.

Another aspect of this invention pertains to methods for preparing a positive working, wet lithographic printing member, for both two layer and three layer product designs with highly crosslinked layers and with various approaches for interaction of the crosslinking chemistry by interfacial reactions between adjacent infrared-absorbing and hydrophilic layers. The infrared-absorbing sensitizers in the infrared-absorbing layer for use with the highly crosslinked layers of the present invention are not limited to organic sensitizers, such as carbon blacks and organic dyes, but may include inorganic and metallic sensitizers.

Still another aspect of the present invention pertains to wet lithographic printing members prepared according to the methods of this invention.

One advantage of the present invention is that the lithographic printing member or plate may be imaged at very low laser power, which eliminates ablation of the infrared-absorbing layer and of the ink accepting surface layer, if present, thus eliminating almost all or all noxious vapors and airborne debris. Since the water-based fountain solution on the wet lithographic printing press will easily clean the laser-exposed infrared-absorbing layer, and also the ink-accepting surface layer if present, from the plate, the plate is suitable for on press imaging and direct printing. Also, in the course of a long printing run, the hydrophilic layer is not solubilized by the fountain solution, and non-hydrophilic substrates may be utilized. Further, the hydrophilic layer under the non-exposed image areas of the present invention provides excellent adhesion to the overlying ink-accepting image layer since it is nearly impossible to undercut through solubilization, particularly when the hydrophilic layer is highly crosslinked, including at its interface to the infrared-absorbing layer.

The superiority of the methods and of the lithographic printing members of the methods of the present invention over those previously known is particularly manifest in the ability to be imaged rapidly with relatively inexpensive diode lasers with large spot sizes; its low laser power imaging characteristic; its elimination of noxious vapors and airborne debris during imaging; its ease of cleaning; its excellent image resolution and printing quality; its resistance to water, which provides excellent durability and image adhesion on the printing press; and its low cost of manufacture.

As one of skill in the art will appreciate, features of one embodiment and aspect of the invention are applicable to other embodiments and aspects of the invention The above-discussed and other features and advantages of the present invention will be appreciated and understood by those skilled in the art from the following detailed description and drawings.

BRIEF DESCRIPTION OF THE DRAWINGS

The foregoing discussion will be understood more readily from the following detailed description of the invention when taken in conjunction with the accompanying drawings.

DETAILED DESCRIPTION OF THE INVENTION

Figure 1:
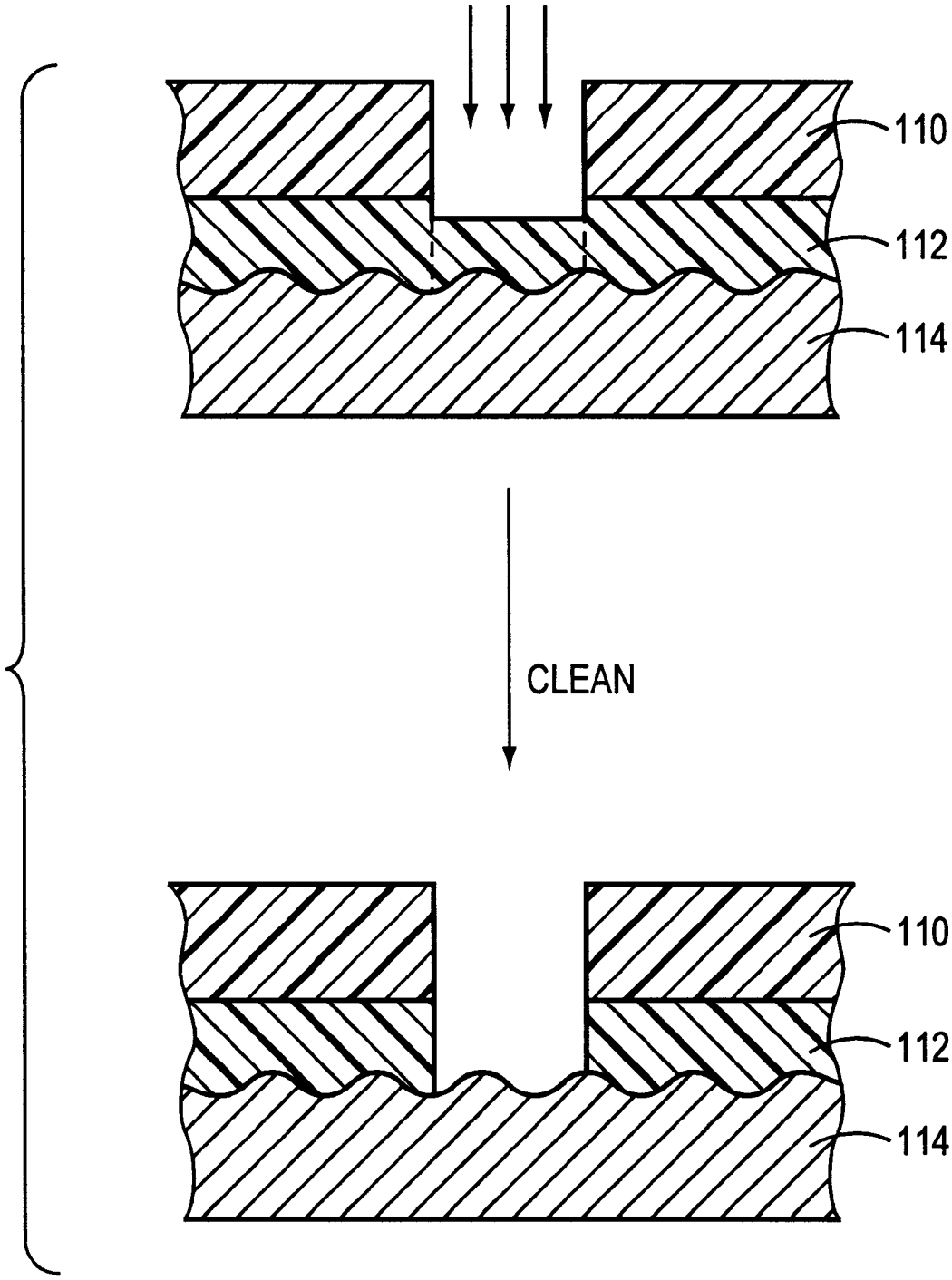
FIG. 1 PRIOR ART
FIG. 1 shows enlarged cross-sectional views of the mechanism, as known in the art, for imaging and cleaning a wet lithographic plate having an absorptive, ablatable top layer, a protective layer, and a hydrophilic metal substrate.

Methods of Preparing and Imaging Lithographic Printing Members Having A Two Layer Product Configuration In preparing lithographic printing members by laser imaging, it would be highly desirable to eliminate or at least greatly reduce the vapors and airborne debris generated in ablative laser imaging. For example, as shown in FIG. 1, U.S. Pat. No. 5,493,971 describes a laser ablation imaging process where imaging radiation fully removes surface layer 10 and at least some of protective layer 12, leaving a residual plug of the protective layer material. The presence of full ablation of at least one layer during the laser imaging process results in airborne debris, and possibly objectionable or noxious vapors and odors, which subsequently need to be captured by expensive and possibly complex environmental control equipment in the laser imaging system. The present invention overcomes this limitation of ablative laser imaging methods and systems for preparing lithographic printing members by providing laser imaging methods and systems that comprise an absence of any ablation, or at least almost all ablation, during the laser imaging exposure.

Figure 2:
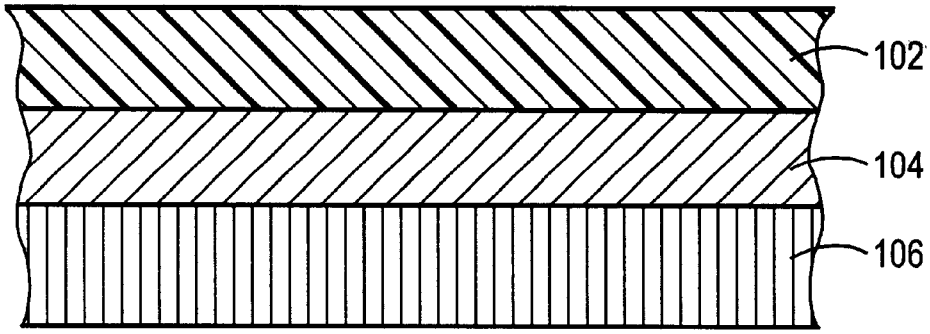
FIG. 2 shows an enlarged cross-sectional view of a lithographic printing member having an infrared-absorbing, ink-accepting surface layer, a hydrophilic layer, and a substrate.
Figure 3A:
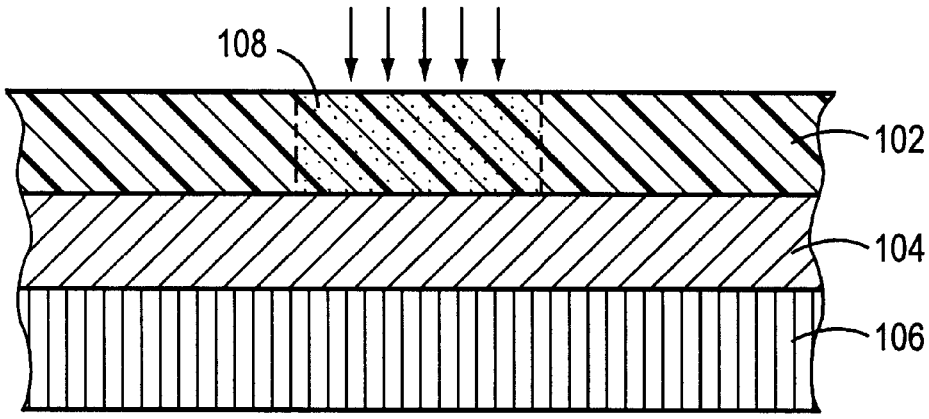
FIGS. 3A and 3B show enlarged cross-sectional views of the lithographic printing member of FIG. 2 in one embodiment of the methods of preparing a wet lithographic printing member of this invention: (A) after exposing to infrared laser imaging radiation; and (B) after cleaning.
Figure 3B:
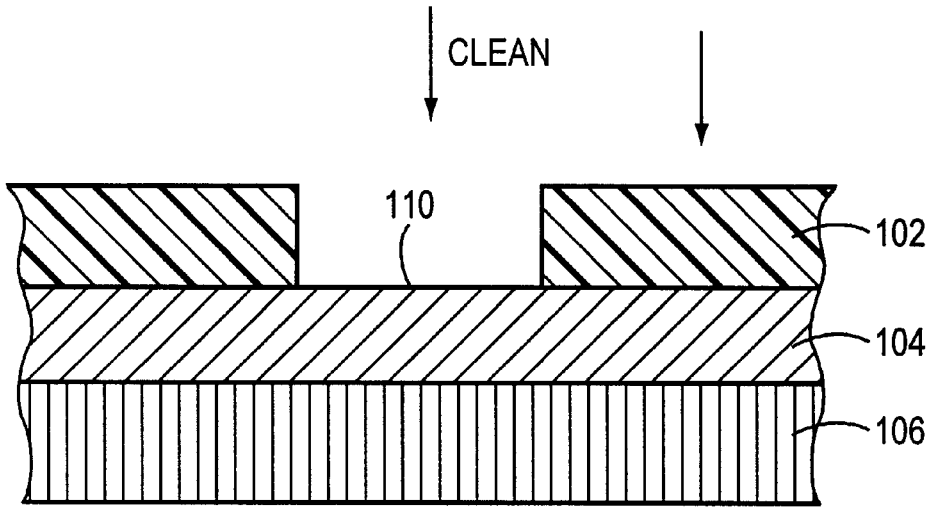

A two layer product configuration for the lithographic printing members for use in the methods of preparing a wet lithographic printing member of the present invention is illustrated in FIG. 2. This two layer product configuration comprises an infrared-absorbing and ink-accepting surface layer 102 and a hydrophilic layer 104 on a substrate 106. FIGS. 3A and 3B show one embodiment of the methods of preparing a wet lithographic printing member of this invention for the lithographic printing member of FIG. 2. As shown in FIG. 3A, laser imaging radiation interacts with layers 102 and 104 without generating ablation byproducts, such as airborne debris and vapors, and leaves a laser-exposed area 108 on the hydrophilic layer 104. As shown in FIG. 3B, the laser-imaged plate is then cleaned with a cleaning solution, such as water, in order to remove laser exposed area 108, thereby exposing the surface 110 of the hydrophilic layer 104. None of this hydrophilic layer 104 is ablated during the laser imaging steps, as illustrated in FIG. 3A. Also, none of this hydrophilic layer 104 is removed during the cleaning step, as illustrated in FIG. 3B. The ablation-resistant and cleaning-resistant properties of this hydrophilic layer, and the interfacial properties between the hydrophilic and infrared-absorbing layers, are among the key features of this invention, as described herein.

Thus, one aspect of the present invention pertains to methods of imaging a wet lithographic printing member, which methods comprise the steps of (a) providing a positive working lithographic printing member, which positive working member comprises a substrate, a hydrophilic layer overlying the substrate, and an ink-accepting and infrared-absorbing surface layer overlying the hydrophilic layer; wherein the surface layer is characterized by absorption of infrared imaging radiation, by not being removable by cleaning with water or a cleaning solution prior to the absorption of infrared imaging radiation, and by being adapted to form a wet lithographic printing surface as a result of an imagewise exposure to absorbable infrared radiation and subsequent removal of the exposed areas of the surface layer by cleaning with water or the cleaning solution to reveal the underlying hydrophilic layer; and the hydrophilic layer is characterized by being not removable by cleaning with water or the cleaning solution; (b) exposing the positive working member of step (a) to absorbable infrared radiation using an infrared emitting laser to effect absorption of infrared radiation in the laser-exposed areas of the surface layer that is sufficient to cause the surface layer in the laser-exposed areas to become removable by cleaning with water or the cleaning solution but insufficient to remove by ablation greater than 10% by weight of the surface layer in the laser exposed areas; and (c) removing, with water or the cleaning solution, the laser-exposed areas of the surface layer to reveal the underlying hydrophilic layer. In one embodiment of the methods, the hydrophilic layer is characterized by the absence of removal of the hydrophilic layer in the laser-exposed areas during steps (b) and (c). In a preferred embodiment, the absorption of infrared radiation in the laser-exposed areas of the surface layer of step (b) is sufficient to cause the surface layer in the laser-exposed areas to become removable by cleaning with water or the cleaning solution but insufficient to remove by ablation greater than 5% by weight, more preferably greater than 2% by weight, and most preferably none, of the infrared-absorbing or surface layer in the laser-exposed area. Thus, the methods of this invention provide a wet lithographic printing member with a very low or zero level of emission of gases and air-borne debris during laser imaging, while also achieving excellent cleanability of the laser-exposed areas by water or an equivalent environmentally-acceptable aqueous solution and excellent image resolution and durability due to the properties of the infrared-absorbing and hydrophilic layers and their interface, as described herein.

In one embodiment, the weight of the infrared-absorbing layer of the printing members of the methods of this invention is from about 0.05 to about 1.0 g/m$^2$. In a preferred embodiment, the weight of the infrared-absorbing layer is from about 0.1 to about 0.5 g/m$^2$. These weights are similar to or lower than those typically used in the infrared-absorbing layers of the ablative laser imageable lithographic printing members as, for example, described in Can. Pat. No. 1,050,805 and U.S. Pat. No. 5,493,971. Thus, in the embodiments of this invention where a small amount of ablation of the infrared-absorbing layers, such as 10% or less by weight, occurs during laser imaging, the amount of ablative byproducts from these thin infrared-absorbing layers, particularly those less than 0.5 g/m$^2$ in weight, is extremely small and does not represent a significant environmental containment issue in comparison to ablative laser imaging methods involving full ablation of thicker infrared-absorbing layers.

Hydrophilic Layers for Methods of Preparing and Imaging Lithographic Printing Members As, for example, illustrated in FIGS. 2, 3A, and 3B, the hydrophilic layer 104 provides a thermal barrier during laser exposure to prevent heat loss and possible damage to the substrate 106, particularly when the substrate is a metal, such as aluminum. Also, it is hydrophilic so that it may function as the background hydrophilic or water-loving area on the imaged wet lithographic plate.

The hydrophilic layer 104 should adhere well to the substrate 106 and to the infrared-absorbing layer 102. In general, polymeric materials satisfying these criteria include those having exposed polar moieties such as hydroxyl or carboxyl groups such as, for example, various cellulosics modified to incorporate such groups, and polyvinyl alcohol polymers.

The hydrophilic third layer 104 withstands repeated application of fountain solution during printing without substantial degradation or solubilization. One test of withstanding the repeated application of fountain solution during printing is a wet rub resistance test, as described in Example 2 of this invention. Satisfactory results for durability in withstanding the repeated application of fountain solution and not being soluble in water, as defined herein for the present invention, are the retention of the 3% dots in the wet rub resistance test.

Suitable polyvinyl alcohol-based coatings may be obtained by combining, for example, AIRVOL 125 polyvinyl alcohol, a trademark for polyvinyl alcohol polymers available from Air Products and Chemicals, Inc. Allentown, Pa.; BACOTE 20, a trademark for an ammonium zirconyl carbonate solution available from Magnesium Elecktron, Flemington, N.J.; glycerol, available from Aldrich Chemical, Milwaukee, Wis.; and TRITON X-100, a trademark for a surfactant available from Rohm & Haas, Philadelphia, Pa.

In addition to its ability to crosslink polymers having hydroxyl and carboxyl groups, ammonium zirconyl carbonate is known to be a precursor, upon heating, to the formation of colloidal zirconium oxide sols and zirconium oxide sol-gel or xerogel layers. In the hydrophilic layers of the lithographic printing members of the methods of this invention, incorporating a large amount of a sol-gel or xerogel precursor, such as ammonium zirconyl carbonate, is advantageous in providing a combination of durability against removal by ablation during laser imaging and against removal by cleaning with water or a cleaning solution together with excellent adhesion to the substrate and the overlying coating layer, hydrophilic properties, and ease of cleanability of the non-ablated infrared-absorbing layer from the surface of the hydrophilic layer in the laser-exposed areas, as illustrated in FIG. 3B. Besides utilizing a first crosslinking agent, such as ammonium zirconyl carbonate, in the hydrophilic layer, and preferably, utilizing a xerogel recursor, such as ammonium zirconyl carbonate in an amount greater than required to crosslink the available crosslinkable groups on the polymers present, it is preferred to add a second crosslinking agent, such as a melamine, to further crosslink the hydrophilic layer and to improve the ease of cleanability at the interface between the hydrophilic layer and the infrared-absorbing layer. A catalyst, such as an organic sulfonic acid component as defined herein, may be added to the hydrophilic layer to increase the rate of reaction of the first and/or second crosslinking agents. The second crosslinking agent and the catalyst may be in the coating formulation of the hydrophilic layer or may be in the coating formulation of an overlying layer, such as the infrared-absorbing layer. In the latter case, the second crosslinking agent and the catalyst are introduced into the hydrophilic layer by penetration of the liquid coating mixture of the overlying layer into the hydrophilic layer. In this case, it is usually important to control the degree of cure of the hydrophilic layer before application of the overlying layer in order to achieve the optimal balance of desired properties, such as ease of cleanability and image resolution and durability. Additional curing of the hydrophilic layer with the first and second crosslinking agents present may then be accomplished by heating during the drying of the overlying layer and/or during any subsequent post-heating steps.

Thus, in one embodiment of the methods of preparing a wet lithographic printing member of the present invention, the hydrophilic layer comprises a crosslinked, polymeric reaction product of a hydrophilic polymer and a first crosslinking agent. Suitable hydrophilic polymers for the crosslinked, polymeric reaction products include, but are not limited to, polyvinyl alcohols and cellulosics. In a preferred embodiment, the hydrophilic polymer is a polyvinyl alcohol. In one embodiment, the first crosslinking agent is a zirconium compound. In one embodiment, the first crosslinking agent is ammonium zirconyl carbonate. In a preferred embodiment, the first crosslinking agent is ammonium zirconyl carbonate, and the ammonium zirconyl carbonate is present in an amount greater than 10% by weight of the polyvinyl alcohol, and, more preferably, present in an amount of 20 to 50% by weight of the polyvinyl alcohol. In another preferred embodiment, the hydrophilic layer further comprises a second crosslinking agent. In one embodiment, the hydrophilic layer further comprises a crosslinked, polymeric reaction product of a polyvinyl alcohol and a second crosslinking agent. In one embodiment, the second crosslinking agent is a melamine. In one embodiment, the hydrophilic layer further comprises a catalyst for the second crosslinking agent. In one embodiment, the catalyst is an organic sulfonic acid component. In one embodiment, the hydrophilic layer comprises an inorganic xerogel layer, which layer preferably comprises a zirconium oxide xerogel.

The hydrophilic layer is coated in this invention typically at a thickness in the range of from about 1 to about 40 microns and more preferably in the range of from about 2 to about 25 microns. After coating, the hydrophilic layer may be dried at a variety of temperatures in order to remove the volatile liquid from the coating mixture. The temperature conditions for curing of the hydrophilic layer depend on many factors, such as on the particular materials in the layer and on whether a crosslinking agent and/or catalyst from a subsequent coating application needs to penetrate and further cure the hydrophilic layer. For example, in the case where a second crosslinking agent and a catalyst from a subsequent coating application will penetrate and further cure the hydrophilic layer, the hydrophilic layer may be dried at a temperature of 135° C. to 155° C. and subsequently only partially cured at a temperature between 145° C. to 185° C. for between 10 seconds and 3 minutes and more preferably at a temperature between 145° C. and 165° C. for between 30 seconds and 2 minutes.

Infrared-Absorbing Layers for Methods of Preparing and Imaging Lithographic Printing Members The primary characteristics of the infrared-absorbing layer are absorption of and sensitivity to infrared laser imaging radiation using commercially practicable laser imaging equipment, sufficient adhesion to the hydrophilic layer to provide long running plates, and retention of small 150 lpi 2% and 3% dots in halftone images when running on press. Also, the infrared-absorbing layer is characterized by being not removable by cleaning with water or a cleaning solution prior to the absorption of infrared imaging radiation. It is also preferable that the infrared-absorbing layer image at low imaging laser power levels where ablation of the infrared-absorbing layer does not take place, yet the laser-exposed areas of the infrared-absorbing layer can be subsequently easily removed by cleaning with water or a cleaning solution. Adhesion to the hydrophilic layer is dependent in part upon the chemical structure and the amount of the material that absorbs the laser imaging radiation and the bonding sites available on the polymers in the infrared-absorbing layer.

It is important that the bonding by the polymers and other materials in the infrared-absorbing layer is strong enough to provide adequate adhesion to the hydrophilic layer, but is chemically transformed during laser exposure sufficiently that it subsequently provides ease of cleaning of the laser-exposed areas of the infrared-absorbing layer from the hydrophilic layer. For example, vinyl-type polymers, such as polyvinyl alcohol, strike an appropriate balance between these two properties. For example, improved adhesion to the hydrophilic layer as well as easy cleaning after imaging is provided by use of a polyvinyl alcohol, such as AIRVOL 125 and AIRVOL 325, incorporated into the infrared-absorbing layer. Crosslinking agents may also be added. An infrared radiation-absorbing compound or sensitizer is added to the composition of the infrared-absorbing layer and dispersed therein. A variety of infrared-absorbing compounds are known and may be utilized as the radiation-absorbing sensitizer in the present invention. Of the infrared sensitizers evaluated, CAB-O-JET 200, a tradename for surface modified carbon blacks available from Cabot Corporation, Bedford, Mass., and BONJET BLACK CW-1, a trademark for a surface modified carbon black aqueous dispersion available from Orient Corporation, Springfield, N.J., surprisingly least affected the adhesion to the hydrophilic layer at the amounts required to give adequate sensitivity for imaging. Thus for example, BONJET BLACK CW-1 has good infrared-sensitizing properties, allows enhanced adhesion to the hydrophilic layer, and also surprisingly allows for easily cleaning and removing the laser-imaged areas of the infrared-absorbing layer after laser exposure under he non-ablative laser imaging conditions of this invention.

Suitable coatings for both the hydrophilic and infrared layers may be prepared by known mixing methods. For example, for the infrared-absorbing layer, a base coating mix may be formed by first mixing all the components, such as water; 2-butoxyethanol; AIRVOL 125 polyvinyl alcohol; CYMEL 303 hexamethoxymethylmelamine crosslinking agent; WITCOBOND 240, a trademark for a water based polyurethane dispersion available from Witco Corporation; and BONJET BLACK CW-1 carbon black, except for not including any crosslinking catalyst. To extend the stability of the coating formulation, any crosslinking agent, such as NACURE 2530, may be subsequently added to the base coating mix or dispersion just prior to the coating application. The coating mix or dispersion may be applied by any of the known methods of coating. However, to best achieve the benefits of the invention, the application of the infrared-absorbing coating layer overlying the hydrophilic layer must preferably be done in a controlled manner. For example, the amount and percent solids of coating applied and the wet dwell time before drying of the coating should be closely controlled when application is over a partially cured hydrophilic coating. Typically, better results are achieved when the hydrophilic coating layer is not wet by large amounts of the infrared-absorbing coating mix and when the wet dwell time is maintained between 1 to 12 seconds, preferably between 1 to 6 seconds. A variety of application methods, such as, for example, wire wound rod coating, reverse roll coating, gravure coating, squeeze coating and slot die coating may all be utilized. After drying to remove the volatile liquids and to provide the level of curing desired, a solid coating layer is formed.

In one embodiment, the weight of the infrared-absorbing layer is from about 0.05 to about 1.0 $g/m^2$. In a preferred embodiment, the weight of the infrared-absorbing layer is from about 0.1 to about 0.5 $g/m^2$. A variety of drying conditions may be used to remove the volatile liquids from the infrared-absorbing layer, to cure the infrared-absorbing layer, and to further cure the hydrophilic layer, if desired. For example, after coating, the layer may be dried and subsequently cured at a temperature between 135° C. and 185° C. for between 10 seconds and 3 minutes and more preferably cured at a temperature between 145° C. and 175° C. for between 30 seconds to 2 minutes.

In one embodiment, the infrared-absorbing layer of the printing member of the methods of the present invention is ink-accepting. An ink-accepting, infrared-absorbing layer of this invention is illustrated, for example, as layer 102 in FIGS. 2, 3A, and 3B, and in Example 2.

In another embodiment, the infrared-absorbing layer may be characterized by not accepting ink and by accepting water on a wet lithographic printing press. For use in positive working, wet lithographic printing member applications, an ink-accepting topcoat layer is utilized with this construction.

In one embodiment of the methods of this invention, the infrared absorbing layer, which is the surface layer in a two layer plate construction of a hydrophilic layer and an infrared absorbing layer on a substrate, comprises one or more polymers and an infrared-absorbing sensitizer. In one embodiment, the infrared-absorbing sensitizer is a carbon black. In one embodiment, the infrared-absorbing layer comprises one or more carbon blacks selected from the group consisting of: sulfonated carbon blacks having sulfonated groups on the surface of the carbon black, carboxylated carbon blacks having carboxyl groups on the surface of the carbon black, and carbon blacks having a surface active hydrogen content of not less than 1.5 mmol/g. Carbon blacks having a surface active hydrogen content of not less than 1.5 mmol/g are described, for example, in U.S. Pat. No. 5,609,671. In a preferred embodiment, the infrared-absorbing sensitiz er is CAB-O-JET 200. In another preferred embodiment, the infrared-absorbing sensitizer is BONJET BLACK CW-1. In one embodiment, the infrared-absorbing sensitizer is present in an amount greater than 55% by weight of the infrared-absorbing layer. In one embodiment, the infrared-absorbing sensitzer is present in an amount greater than 65% by weight of the infrared-absorbing layer.

In one embodiment of the methods of this invention, one of the one or more polymers of the infrared-absorbing layer comprises a polymer selected from the group consisting of: polyvinyl alcohols, polyurethanes, epoxy polymers, vinyl polymers, acrylic polymers, and cellulosics. As used herein, the term "acrylic polymers" pertains to polymers that comprise acrylic acid, acrylate, or methacrylate groups. In one embodiment, the infrared-absorbing layer comprises a polyvinyl alcohol. In one embodiment, the polyvinyl alcohol is present in an amount of 20 to 95 per cent by weight of the total weight of polymers present in the infrared-absorbing layer. In one embodiment, the polyvinyl alcohol is present in an amount of 25 to 75 per cent by weight of the total weight of polymers present in the infrared-absorbing layer. Suitable polymers for use in combination with polyvinyl alcohol in the infrared-absorbing layer include, but are not limited to other water-soluble or water-dispersible polymers such as, for example, polyurethanes, cellulosics, epoxy polymers, acrylic polymers, and vinyl polymers.

In one embodiment of the methods of the present invention, the infrared-absorbing layer comprises a crosslinking agent, preferably a melamine. In one embodiment, one or more polymers of the infrared-absorbing layer comprise a crosslinked, polymeric reaction product of a polymer and a crosslinking agent. In a preferred embodiment, the crosslinked, polymeric reaction product is selected from the group consisting of crosslinked reaction products of a crosslinking agent with the following polymers: a polyvinyl alcohol; a polyvinyl alcohol and a vinyl polymer; a cellulosic polymer; a polyurethane; an epoxy polymer; an acrylic polymer; and a vinyl polymer.

In one embodiment of the methods of the present invention, the infrared-absorbing layer further comprises a catalyst in addition to one or more polymers and an infrared-absorbing sensitizer.

In one embodiment of the methods of this invention, the infrared-absorbing layer comprises one or more polymers, an infrared-absorbing sensitizer, and an organic sulfonic acid component, preferably a component of an amine-blocked p-toluenesulfonic acid. The term "organic sulfonic acid," as used herein, refers to organic compounds that have at least one sulfonic acid moiety, —$SO_3H$, covalently bonded to a carbon atom of the organic compound. The term "organic sulfonic acid component," as used herein, pertains to free organic sulfonic acids and also pertains to the free organic sulfonic acids formed when a blocked or latent organic sulfonic acid catalyst, is decomposed, such as by heat or by radiation, to form a free or unblocked organic sulfonic acid to catalyze the desired curing reaction, as is well known in the art. The weight of the free organic sulfonic acid that may be obtained from the blocked or latent organic sulfonic acid catalyst is used herein to calculate the weight per cent of the organic sulfonic acid component based on the total weight of polymers present in the coating layer. As is well known in the art, the blocked organic sulfonic acid catalysts may be an adduct or complex of an organic sulfonic acid with a complexing material, such as an amine, and the molar ratios of the organic sulfonic acid and the complexing material may vary widely, such as, for example, from 1.0:0.5 to 1.0:2.0. Alternatively, the blocked organic sulfonic acid catalysts may be a reaction product of an organic sulfonic acid with a suitable material, such as, for example, with an alcohol to provide the blocked catalyst in the form of an ester of an organic sulfonic acid. A wide variety of blocked or latent organic sulfonic acid catalysts are known and may be utilized in the present invention to provide the organic sulfonic acid component. Examples of suitable blocked or latent organic sulfonic acid catalysts that provide suitable organic sulfonic acid components include, but are not limited to, amine-blocked organic sulfonic acids such as, for example, described in U.S. Pat. Nos. 4,075,176; 4,200,729; 4,632,964; 4,728,545; 4,812,506; 5,093,425; 5,187,019; 5,681,890; and 5,691,002; esters of an organic sulfonic acid as, for example, described in U.S. Pat. Nos. 4,192,826; 4,323,660; 4,331,582; 4,618,564; 5,102,961; 5,364,734; and 5,716,756; reaction products of an organic sulfonic acid and a glycidamide as, for example, described in U.S. Pat. No. 4,839,427; and amides of an organic sulfonic acid as, for example, described in U.S. Pat. No. 4,618,526. Instead of the free or unblocked organic sulfonic acid in the coating solutions to be applied to a substrate, the blocked or latent organic sulfonic acid catalysts are typically utilized to crosslink coatings in order to provide a stable shelf life to the coating solution by reducing the viscosity buildup due to premature crosslinking and because of the better coating uniformity and water resistance often obtained in the finished coating layers.

An example of an amine-blocked p-toluenesulfonic acid (PTSA) is NACURE 2530, a tradename for a catalyst available from King Industries, Norwalk, Conn. These PTSA-based catalysts assist in the curing of, for example, CYMEL 303, a trademark for melamine crosslinking agents available from Cytec Industries, Inc., Wayne, N.J., with polymers in the infrared-absorbing layer and, when there is penetration of the catalyst into underlying layers such as the hydrophilic layer, with polymers in these underlying layers. Examples of these crosslinkable polymers are AIRVOL 125, a trademark for polyvinyl alcohol polymers available from Air Products, Allentown, PA, and UCAR WBV-110, a trademark for a vinyl copolymer water-based dispersion available from Union Carbide Corporation, Danbury, Conn. To calculate the weight per cent of organic sulfonic acid component in the infrared-absorbing layer of the present invention, the weight of organic sulfonic acid component (p-toluenesulfonic acid constitutes 25 per cent by weight of NACURE 2530 in the examples of the present invention) is divided by the total dry weight of polymers present based on the combined weight of crosslinking agent and any polymers present.

A wide variety of organic sulfonic acid components are known and may be utilized in the present invention. Examples of suitable organic sulfonic acid components include, but are not limited to, organic sulfonic acids having a pKa below 4, such as, for example, p-toluenesulfonic acid, dodecylbenzenesulfonic acid, dinonylnaphthalene sulfonic acid, tridecylbenzene sulfonic acid, methane sulfonic acid, polystyrene sulfonic acid, and dodecylbenzenedisulfonic acid. In one embodiment, the organic sulfonic acid component of the present invention is an aromatic sulfonic acid. In a preferred embodiment, the organic sulfonic acid component is p-toluenesulfonic acid (PTSA). In one embodiment, the organic sulfonic acid component of the present invention is a component of a blocked or latent organic sulfonic acid catalyst, preferably an amine-blocked organic sulfonic acid. The term "amine," as used herein pertains to ammonia, as well as to aliphatic primary, secondary, and tertiary amines, including heterocyclic amines having a saturated ring.

Surprisingly, it has been found that significantly increased levels of an organic sulfonic acid component, such as the p-toluenesulfonic acid in NACURE 2530 to weight per cents greater than 12% and preferably than 25%, of the total weight of polymers present in conjunction with large amounts of water-dispersible infrared-absorbing, carbon black sensitizer in the infrared-absorbing layer to weight per cents of sensitizer greater than 55% of the dry layer weight provide significant improvements in the ease of cleaning the laser-exposed areas, in a significant reduction of the laser power required for imaging while not affecting durability and adhesion of the ink-accepting areas of the plate during long press runs, and in the fine image resolution and printing quality that can be achieved. Even more surprisingly, the large reduction in laser imaging power results in lower imaging temperatures and most importantly, in the absence of ablation of the infrared absorbing layer. The absence of ablation during imaging results in a significant reduction, if not elimination, of noxious vapors and airborne debris, thus eliminating the need for expensive vapor and debris removal and capture equipment on the laser imaging system. These benefits from high levels of organic sulfonic acid components may be obtained without any significant disadvantages, such as loss in image resistance to solubilization or removal by water, by the fountain solution, or by a cleaning solution.

Thus, in a preferred embodiment, the infrared-absorbing layer comprises greater than 25 weight per cent of an organic sulfonic acid component. In one embodiment, the organic sulfonic acid component is present in an amount of 25 to 75 weight per cent of the total weight of polymers present in the infrared-absorbing layer of the printing member of the methods of the present invention. In another embodiment, the organic sulfonic acid component is present in an amount of 35 to 55 weight per cent of the total weight of polymers present in the infrared-absorbing layer. In one embodiment, the infrared-absorbing layer comprises greater than 5% by weight of organic sulfonic acid component. In one embodiment, the infrared-absorbing layer comprises greater than 12% by weight of the organic sulfonic acid component.

Substrates for Methods of Preparing and Imaging Lithographic Printing Members

Suitable substrates for the support substrate of the lithographic printing members of the methods of this invention may be a variety of different materials, including those known in the art as substrates for lithographic printing plates, such as, for example, metals, papers, and polymeric films. Since the hydrophilic layer 104 as illustrated in FIGS. 2, 3A, and 3B, is not soluble in water, in a cleaning solution, or in the fountain solution, and further is not removed during the laser imaging and cleaning process, the substrate 106 does not need to be hydrophilic to provide the discrimination between the ink-accepting or non-hydrophilic image areas of the surface layer and the water-accepting or hydrophilic background areas of the plate needed for wet lithographic printing. The term, "hydrophilic," as used herein, pertains to the property of a material or a composition of materials that allows it to preferentially retain water or a water-based fountain solution in wet lithographic printing while the non-hydrophilic, ink-accepting materials or composition of materials on the surface of the plate preferentially retain the oily material or ink. Thus, the substrate 106 either may be hydrophilic or may be non-hydrophilic/ink-accepting when a hydrophilic layer such as hydrophilic layer 104 is interposed between the infrared-absorbing layer and the substrate. For example, the substrate may be a metal substrate, such as aluminum, comprising a non-hydrophilic polymer layer on at least one surface of the substrate to provide a non-hydrophilic metal substrate.

Suitable metals include, but are not limited to, aluminum, copper, steel, and chromium, preferably that have been rendered hydrophilic through graining or other treatments. The printing members of this invention preferably use an anodized aluminum support substrate. Examples of such supports include, but are not limited to, aluminum which has been anodized without prior graining, aluminum which has been grained and anodized, and aluminum which has been grained, anodized, and treated with an agent effective to render the substrate hydrophilic, for example, treatment to form a silicate layer. It is preferred in this invention to use aluminum, which has been grained, anodized, and treated with a hydrophilic material. For increased ease of cleanability and better image resolution, in a preferred embodiment, the metal substrate is an aluminum substrate comprising a surface of uniform, non-directional roughness and microscopic depressions, which surface is in contact to the hydrophilic layer and, more preferably, this surface of the aluminum substrate has a peak count in the range of 300 to 450 peaks per linear inch which extend above and below a total bandwidth of 20 microinches, as described for example, in International Publication No. WO 97/31783. In one embodiment, the aluminum substrate is SATIN FINISH aluminum litho sheet, a trademark for aluminum sheets available from Alcoa, Inc., Pittsburgh, Pa.

A wide variety of papers may be utilized. Typically, these papers have been treated or saturated with a polymeric treatment to improve dimensional stability, water resistance, and strength during the wet lithographic printing. Examples of suitable polymeric films include, but are not limited to, polyesters such as polyethylene terephthalate and polyethylene naphthalate, polycarbonates, polystyrene, polysulfones, and cellulose acetate. A preferred polymeric film is polyethylene terphthalate film, such as, for example, the polyester films available under the trademarks of MYLAR and MELINEX polyester films from E.I. Dupont de Nemours Co., Wilmington, Del. It is preferred that the polymeric film substrate be wettable by aqueous coating fluids and be adherable to hydrophilic polymers. A number of commercial suppliers of polymeric films provide products with these properties. Preferred thicknesses for support substrate 106 range from 0.003 to 0.02 inches, with thicknesses in the range of 0.005 to 0.015 inches being particularly preferred.

Methods of Preparing and Imaging Lithographic Printing Members Having a Two Layer Product Configuration with a Primer Layer The present invention utilizes novel infrared-absorbing and hydrophilic layers with special attention to the interface between these two layers to enhance the laser imaging sensitivity, absence of ablation and airborne byproducts, printing quality, cleanability, press durability, ink-accepting image adhesion, and fine dot resolution of lithographic printing plates. Referring to FIG. 2, another aspect of this invention is the incorporation of a primer layer interposed between the infrared-absorbing layer 102 and the hydrophilic layer 104, wherein the primer layer comprises an adhesion-promoting agent. Suitable adhesion-promoting agents include, but are not limited to, organic sulfonic acid components, zirconium compounds, titanates, and silanes. In one embodiment, the organic sulfonic acid component of the adhesion-promoting agent in the primer layer is an aromatic sulfonic acid. In a preferred embodiment, the organic sulfonic acid component of the adhesion-promoting agent in the primer layer is p-toluenesulfonic acid.

In one embodiment, the organic sulfonic acid component in the primer layer interposed between the infrared-absorbing layer 102 and the hydrophilic layer 104 is present in an amount of 2 to 100 weight per cent of the primer layer, preferably in an amount of 50 to 100 weight per cent of the primer layer, and most preferably in an amount of 80 to 100 weight per cent of the primer layer.

In one embodiment, the thickness of the primer layer interposed between the ablative-absorbing layer 102 and the hydrophilic layer 104 is from about 0.01 to about 2 microns, and preferably from about 0.01 to about 0.1 microns. When this primer layer comprising an organic sulfonic acid component is present, increased levels of an organic sulfonic acid component in the infrared-absorbing layer 102 may not be necessary to provide the multiple benefits desired, and the level of an organic sulfonic acid component in the infrared-absorbing layer 102 may be less than 25 weight per cent of the total weight of the polymers present in the infrared-absorbing layer or may even be negligible.

In one embodiment, the adhesion-promoting agent of the primer layer is ammonium zirconyl carbonate such as, for example, BACOTE 20. BACOTE 20 is a zirconia sol from Magnesium Elektron, Inc., with a weight equivalent of 20% zirconium oxide. The cured residue of an applied BACOTE 20 solution is reported to be water-insoluble and to have excellent adhesion to chrome substrates and photopolymer coatings in photopolymer coated lithographic printing plates and may also have hydrophilic properties depending on the overlying coating, as described in U.S. Pat. Nos. 4,522,912 and 4,581,825. In another embodiment, the adhesion-promoting agent of the primer layer is zirconium propionate. Other suitable zirconium compounds in the primer layer of the present invention include, but are not limited to, those zirconium-based adhesion promoters described in "The Use of Zirconium in Surface Coatings," Application Information, Sheet 117 (Provisional), by P.J. Moles, Magnesium Elektron, Inc., Flemington, N.J.

Thus, one aspect of the methods of imaging a wet lithographic printing member of this invention pertains to the inclusion of a primer layer interposed between the hydrophilic layer and the infrared-absorbing surface layer to further enhance the desirable properties of the infrared-absorbing and hydrophilic layers and their interface which greatly influence the amount of airborne materials produced during laser imaging, the speed of laser imaging, the ease of cleanability by water during removal of the laser-exposed areas, and the image resolution and durability, as described herein. In one embodiment, the methods of imaging a wet lithographic printing member of this invention comprise the steps of (a) providing a positive working lithographic printing member, which positive working member comprises a substrate, a hydrophilic layer overlying the substrate, an ink-accepting and infrared-absorbing surface layer overlying the hydrophilic layer, and a primer layer interposed between the hydrophilic layer and the surface layer; wherein the surface layer is characterized by absorption of infrared imaging radiation, by being not removable by cleaning with water or a cleaning solution prior to absorption of infrared imaging radiation, and by being adapted to form a wet lithographic printing surface as a result of an imagewise exposure to absorbable infrared radiation and subsequent removal of the exposed areas of the surface layer by cleaning with water or the cleaning solution to reveal the underlying hydrophilic layer; the primer layer comprising an adhesion-promoting agent; and the hydrophilic layer is characterized by being not removable by cleaning with water or the cleaning solution; (b) exposing the positive working member of step (a) to absorbable infrared radiation using an infrared-emitting laser to effect absorption of infrared radiation in the laser-exposed areas of the surface layer that is sufficient to cause the surface layer in the laser-exposed areas to become removable by cleaning with water or the cleaning solution but insufficient to remove by ablation greater than 10% by weight of the surface layer in the laser-exposed areas; and (c) removing, with water or the cleaning solution, the laser-exposed areas of the surface layer to reveal the underlying hydrophilic layer. In one embodiment, the thickness of the primer layer is from about 0.01 to about 0.1 microns. In one embodiment, the adhesion-promoting agent comprises a crosslinked, polymeric reaction product of a hydrophilic polymer and a crosslinking agent. In one embodiment, the primer layer further comprises a catalyst. In one embodiment of the methods, the hydrophilic layer is characterized by the absence of removal of the hydrophilic layer in the laser-exposed areas during steps (b) and (c). In a preferred embodiment, the absorption of infrared radiation in the laser-exposed areas of the surface layer of step (b) is sufficient to cause the surface layer in the laser-exposed areas to become removable by cleaning with water or the cleaning solution but insufficient to remove by ablation greater than 5% by weight, more preferably greater than 2% by weight, and most preferably none, of the infrared-absorbing or surface layer in the laser-exposed areas.

Figure 4:
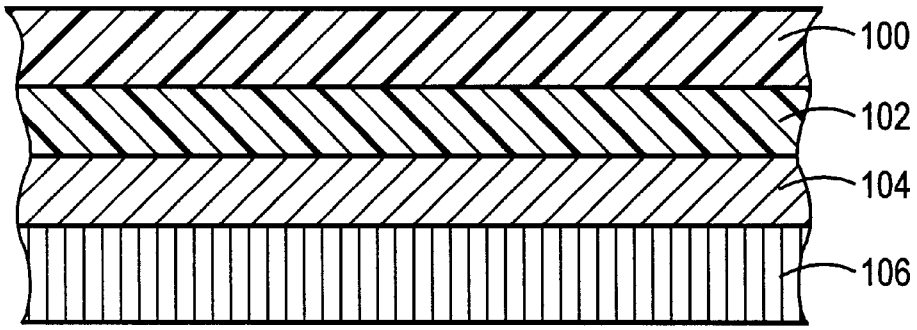
FIG. 4 shows an enlarged cross-sectional view of a lithographic printing member having an ink-accepting surface layer, an infrared-absorbing layer, a hydrophilic layer, and a substrate.
Figure 5A:
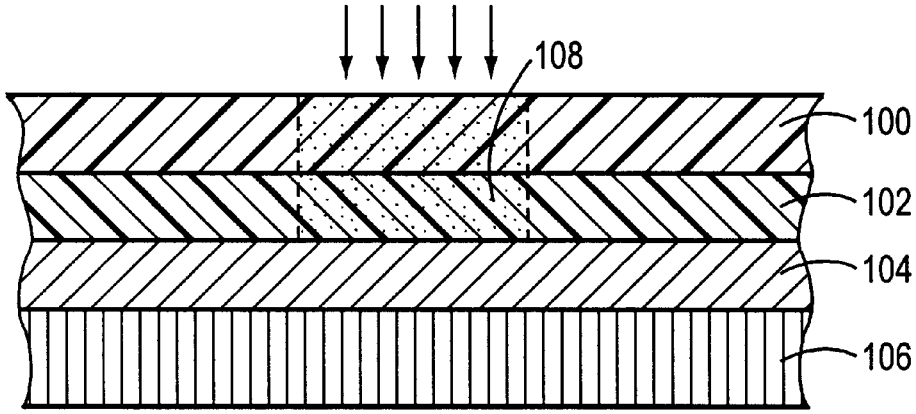
FIGS. 5A and 5B show enlarged cross-sectional views of the lithographic printing member of FIG. 4 in one embodiment of the methods of preparing a wet lithographic printing member of this invention: (A) after exposing to infrared laser imaging radiation; and (B) after cleaning.
Figure 5B:
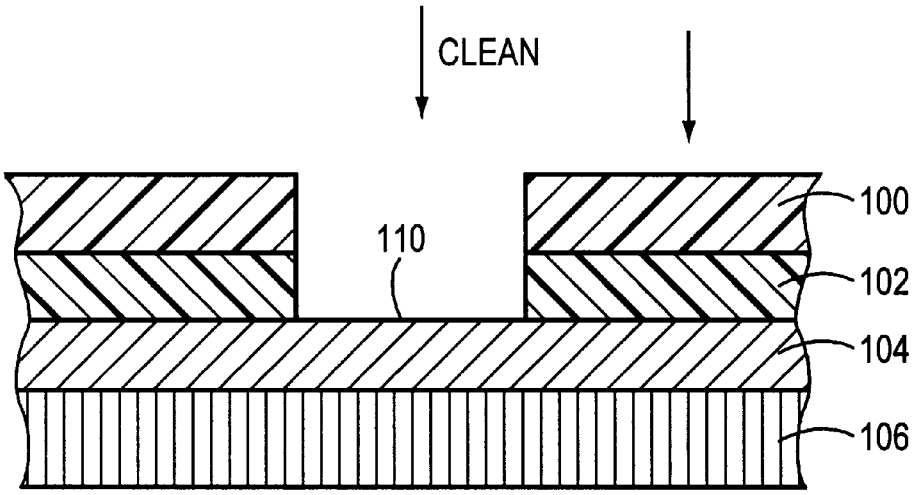

Methods of Preparing and Imaging Lithographic Printing Members Having a Three Layer Product Configuration A three layer configuration for the lithographic printing members for use in the methods of preparing wet lithographic member of the present invention is illustrated in FIG. 4. This three layer product configuration comprises an ink-accepting surface layer 100, an infrared-absorbing layer 102, and a hydrophilic layer 104 on a substrate 106. FIGS. 5A and 5B show one embodiment of the methods of preparing wet lithographic printing members of this invention for the lithographic printing member of FIG. 4. As shown in FIG. 5A, laser imaging radiation interacts with layers 100, 102, and 104 without generating ablation by-products, such as airborne debris and vapors, and leaves a laser-exposed area 108 on the hydrophilic layer 104. As shown in FIG. 5B, the laser-imaged plate is then cleaned with a cleaning solution, such as water, in order to remove laser exposed area 108, thereby exposing the surface 110 of the hydrophilic layer 104. None of this hydrophilic layer 104 is ablated during the laser imaging steps, as illustrated in FIG. 5A. Also, none of this hydrophilic layer 104 is removed during the cleaning step, as illustrated in FIG. 5B. The ablation-resistant and cleaning-resistant properties of this hydrophilic layer, and the interfacial properties between the hydrophilic layer and the overlying infrared-absorbing layer, are among the key features of this invention, as described herein.

Thus, one aspect of the methods of imaging a wet lithographic printing member of the present invention pertains to the inclusion of an additional ink-accepting surface layer overlying the infrared-absorbing layer to provide a basic three layer product configuration of ink-accepting surface layer/infrared-absorbing layer/hydrophilic layer on the substrate. This additional ink-accepting surface layer may be useful in achieving the best overall balance of properties, such as the speed of laser imaging, the ease of cleanability by water during removal of the laser-exposed areas, and particularly the image resolution and durability. In one embodiment, the method of imaging a wet lithographic printing member comprises the steps of (a) providing a positive working lithographic printing member, which positive working member comprises a substrate, a hydrophilic layer overlying the substrate, an infrared-absorbing layer overlying the hydrophilic layer, and an ink-accepting surface layer overlying the infrared-absorbing layer; the surface layer being characterized by the absence of ablation from absorption of infrared imaging radiation; the infrared-absorbing layer being characterized by absorption of imaging radiation; the surface layer and the infrared-absorbing layer being characterized by being not removable by cleaning with water or a cleaning solution prior to the absorption of infrared imaging radiation and by being adapted to form a wet lithographic printing surface as a result of an image-wise exposure to absorbable infrared radiation and subsequent removal of the exposed areas of the surface layer and the infrared-absorbing layer by cleaning with water or the cleaning solution to reveal the underlying hydrophilic layer; and the hydrophilic layer being characterized by being not removable by cleaning with water or the cleaning solution; (b) exposing the positive working member of step (a) to absorbable infrared radiation using an infrared-emitting laser to effect absorption of infrared radiation in the laser-exposed areas of the infrared-absorbing layer that is sufficient to cause the surface layer and the infrared-absorbing layer in the laser-exposed areas to become removable by cleaning with water or the cleaning solution but insufficient to remove by ablation greater than 10% by weight of the combined surface layer and infrared-absorbing layer in the laser-exposed areas; and (c) removing, with water or the cleaning solution, the laser-exposed areas of the surface layer and the infrared-absorbing layer to reveal the underlying hydrophilic layer. In one embodiment of the methods, the hydrophilic layer is characterized by the absence of removal of the hydrophilic layer in the laser-exposed areas during steps (b) and (c). In a preferred embodiment, the absorption of infrared radiation in the laser-exposed areas of the infrared-absorbing layer of step (b) is sufficient to cause the ink-accepting surface layer and the infrared-absorbing layer in the laser-exposed areas to become removable by cleaning with water or the cleaning solution but insufficient to remove by ablation greater than 5% by weight, more preferably greater than 2% by weight, and most preferably none, of the combined ink-accepting surface layer and infrared-absorbing layer in the laser-exposed areas.

Suitable infrared-absorbing layers, hydrophilic layers, and substrates for the three layer product configuration, as illustrated in one embodiment in FIG. 4, 5A, and 5B, are as described herein for the corresponding layers in the two layer product configuration of the lithographic printing members of the methods of the present invention. For example, in one embodiment, the infrared-absorbing layer of the three layer design is ink-accepting. Since the surface layer of the three layer product configuration is ink-accepting, in another embodiment, the infrared-absorbing layer of the three layer design is characterized by not accepting ink and by accepting water on a wet lithographic printing press. Also, the three layer product configuration may optionally have a primer layer interposed between the infrared-absorbing layer and the hydrophilic layer as described herein for the corresponding primer layer on the two layer product configuration.

Ink Accepting Surface Layer for Methods of Preparing and Imaging Lithographic Printing Members Having a Three Layer Product Configuration The primary characteristics of the ink-accepting surface layer 100, as illustrated in FIGS. 4, 5A, and 5B, are its oleophilicity and hydrophobicity, ability to be imaged in conjunction with the underlying infrared-absorbing layer 102, resistance to solubilization or removal by water, cleaning solutions, and fountain solutions, and durability on the printing press. For example, the ink-accepting surface layer should be resistant to the press chemistry, which may include organic solvents. Suitable polymers utilized in this layer should have excellent adhesion to the infrared-absorbing layer 102 and high wear resistance. They can be either water-based or solvent-based polymers. Ink-accepting surface layer 100 does not need to comprise an infrared-absorbing sensitizer and is characterized by the absence of ablative absorption by the infrared imaging radiation. This layer also may include a crosslinking agent, which provides improved bonding to the infrared-absorbing layer 102 and increased durability of the plate for extremely long print runs.

Suitable polymers include, but are not limited to, cellulosics such as nitrocellulose, acrylic polymers, polyurethanes, and epoxy polymers. For example, polyurethane based materials are typically extremely tough and may have thermosetting or self-curing capability. Mixing and coating application methods known in the art may be used to prepare the ink-accepting surface layer. In one example of a coating for the ink-accepting surface layer, a mixture of nitrocellulose polymer and hexamethoxymethylmelamine crosslinking agent in a suitable solvent blend is combined, followed by the addition of a suitable amine-blocked p-toluenesulfonic acid catalyst to form the finished coating mix. The coating mix is then applied to the infrared-absorbing layer 102 using one of the conventional methods of coating application, such as wire wound rod coating, reverse roll coating, gravure coating, squeeze coating, and slot die coating, and subsequently dried to remove the volatile liquids and cured to form a coating layer.

Polymeric systems containing components in addition to a cellulosic or other primary polymer may also be combined to form the ink-accepting surface layer 100. For example, an epoxy polymer may be added to a nitrocellulose polymer in the presence of a crosslinking agent and a catalyst. After coating, the layer is dried and preferably cured at a temperature of between 75° C. and 175° C.

In one embodiment of the methods of imaging a wet lithographic printing member with a three-layer product design of this invention, the ink-accepting surface layer comprises a crosslinked, polymeric reaction product of a polymer and a crosslinking agent. Suitable polymers for the crosslinked, polymeric reaction product include, but are not limited to, cellulosics, acrylic polymers, polyurethanes, and epoxy polymers. In one embodiment, the ink-accepting surface layer further comprises an organic sulfonic acid component. In one embodiment, the weight of the ink-accepting surface layer is from about 0.05 to about 0.5 g/m$^2$. In a preferred embodiment, the weight of the ink-accepting surface layer is from about 0.1 to about 0.3 g/m$^2$.

Imaging Apparatus

Imaging apparatus suitable for use in conjunction with the present invention include, but are not limited to, known laser imaging devices such as infrared laser devices that emit in the infrared spectrum. Examples include the PEARLSETTER 74, a trademark for laser imaging equipment available from PRESSTEK, Inc., Hudson, N.H., and the CREO TRENDSETTER 1.7X, a trademark for laser imaging equipment available from Creo, Inc., Burnaby, British Columbia. Laser outputs can be provided directly to the plate surface via lenses or other beam-guiding components, or transmitted to the surface of a printing plate from a remotely sited laser using a fiber-optic cable. The imaging apparatus can operate on its own, functioning solely as a platemaker, or it can be incorporated directly into a lithographic printing press. In the latter case, a cleaning step is necessary prior to or during the startup of the printing operation.

The laser-induced imaging of the wet lithographic printing plates of the present invention may be carried out using a wide variety of laser imaging systems known in the art of thermal laser-induced imaging, including, but not limited to, the use of continuous and pulsed laser sources of infrared wavelengths. Preferably, the laser-induced imaging of this invention is carried out utilizing a continuous laser source of near-infrared radiation, such as, for example, with a diode laser emitting at 830 nm.

Imaging Techniques

A lithographic printing plate of the methods of the present invention is selectively exposed, in a pattern representing an image, to the output of an imaging laser, which is scanned over the plate. Referring to FIG. 5A, radiative laser output exposes the infrared-absorbing layer 102 and the ink-accepting surface layer 100 in a desired imagewise pattern. As shown in one embodiment in FIG. 5A, imaging radiation transforms layers 100 and 102 without generating ablation products such as ablation debris and airborne particles, leaving a laser exposed, removable area 108 on the hydrophilic layer 104. The laser-exposed plate is then cleaned with water or a cleaning solution in order to remove laser exposed area 108, thereby exposing the surface of the hydrophilic layer 104 in area 110 as shown in FIG. 5B.

Similarly, for a two layer product configuration, referring to FIG. 3A, infrared imaging radiation exposes the infrared-absorbing layer 102 in a desired imagewise pattern. As shown in one embodiment in FIG. 3A, infrared imaging radiation transforms layer 102 without generating ablation debris and airborne particles, leaving a laser exposed, removable area 108 on the hydrophilic layer 104. The laser-exposed plate is then cleaned with water or a cleaning solution in order to remove laser-exposed area 108, thereby exposing the surface of the hydrophilic layer 104 in area 110, as shown in FIG. 5B.

One aspect of the present invention pertains to a method of imaging a wet positive working lithographic printing member having an infrared-absorbing imaging layer, which member can be imaged without using sufficient energy to form a lithographic printing surface by laser ablation removal of the imaging layer and without the use of alkaline or solvent developing solutions; the method comprising the steps of (a) providing a positive working lithographic printing member, the positive working member comprising a substrate, a hydrophilic layer overlying the substrate, and an ink-accepting, infrared radiation-absorbing, heat-sensitive, polymeric surface layer which is not readily removable from the hydrophilic layer by cleaning with water or a cleaning solution prior to the absorption of infrared imaging radiation and is adapted to form a wet lithographic printing surface as a result of an imagewise exposure to absorbable infrared radiation and subsequent easy removal of the exposed areas of the surface layer by cleaning with water or the cleaning solution to reveal the underlying hydrophilic layer; and the hydrophilic layer being characterized by being not removable by cleaning with water or the cleaning solution; (b) exposing the positive working member to absorbable infrared radiation using an infrared emitting laser to effect absorption of infrared radiation and localized generation of heat in the laser-exposed areas of the surface layer that is sufficient to cause the surface layer in the laser-exposed areas to become removable by cleaning with water or the cleaning solution but insufficient to remove by ablation greater than 10% by weight, preferably greater than 5%, more preferably greater than 2%, and most preferably none, of the surface layer in the laser-exposed areas; and (c) removing, with water or the cleaning solution, the laser-exposed areas of the surface layer to reveal the underlying hydrophilic layer.

Another aspect of the present invention pertains to wet lithographic printing members prepared according to the methods of this invention, as described herein and as illustrated, for example, in FIGS. 2, 3A, 3B, 4, 5A, and 5B.

Thus, for example, one aspect of the present invention pertains to a positive working lithographic printing member which comprises (a) a substrate; (b) a hydrophilic layer overlying the substrate; and (c) an ink-accepting surface layer overlying the hydrophilic layer; wherein the surface layer is characterized by absorption of infrared imaging radiation, by being not removable by cleaning with water prior to the absorption of infrared imaging radiation, and by being adapted to form a wet lithographic printing surface as a result of an imagewise exposure to absorbable infrared radiation that removes by ablation less than 10% by weight, preferably less than 5%, more preferably less than 2%, and most preferably none, of the surface layer in the laser-exposed areas and of subsequent removal of the laser-exposed areas of the surface layer by cleaning with water to reveal the underlying hydrophilic layer; and said hydrophilic layer is characterized by being not removable by cleaning with water.

EXAMPLES

Several embodiments of the present invention are described in the following examples, which are offered by way of description and not by way of limitation.

Example 1

A lithographic printing plate substrate with a hydrophilic thermal barrier layer in accordance with the invention, as illustrated by layer 104 in FIG. 2 of this application, was prepared on a production line by coating a web of grained, anodized, silicated aluminum. The hydrophilic thermal barrier layer had the composition on a dry weight basis shown below.

| Hydrophilic Layer Composition | |
|---|---|
| AIRVOL 325 | 4.28 |
| BACOTE 20 | 1.75 |
| GLYCEROL | 0.17 |
| TRITON X-100 | 0.07 |
| BYK 333 | 0.10 |

AIRVOL 325 is a highly hydrolyzed grade of polyvinyl alcohol from Air Products & Chemical, Inc. BACOTE 20 is an alkaline aqueous solution of stabilized ammonium zirconium carbonate containing 20% $ZrO_2$ from Magnesium Elektron, Inc. of Flemington, N.J. TRITON X-100 is a hydrocarbon surfactant from Rohm & Haas. BYK 333 is a trademark for a silicone surfactant from Byk Chemie USA of Wallingford, Conn.

The above components were mixed with water to make a 6.3% by weight solution. This solution was applied to the aluminum web with a #18 wire wound rod and dried for 60 seconds at 285° F. with hot air and then partially cured using infrared heat for 60 seconds at a temperature adequate to raise the temperature of the web to 310 to 320° F. The degree of cure of the hydrophilic layer was tested by rubbing very hard with a water wet WEBRIL wipe, a trademark for a lint-free cloth available from Veratec Corporation, Walpole, Mass. The wet rubs each involve a durable pass back and forth across the coating layer so that 30 durable rubs in the wet rub resistance tests of this invention actually involve a total of 60 passes or wet rubs across the coating layer. Optimum performance characteristics of the final imaged plate is achieved in some embodiments when no more than 30 double rubs, preferably 10 to 15 double rubs, are needed to remove the hydrophilic layer down to the substrate when tested after coating, drying, and partially curing the hydrophilic layer but prior to subsequent coating, drying, and curing steps.

Example 2

Two layer wet lithographic printing plates, as illustrated in FIG. 2, were prepared by applying ink-accepting, infrared-absorbing layers of the following compositions to the hydrophilic thermal barrier coated aluminum substrate prepared as described in Example 1. Example 2A is a comparative example that represents a wet lithographic printing plate that only images acceptably by an ablation-imaging process. Example 2B through 2F are examples of lithographic printing plates in accordance with the present invention.

| | Composition of Dry Coating (wt %) | | | | | |
|---|---|---|---|---|---|---|
| | 2A | 2B | 2C | 2D | 2E | 2F |
| AIRVOL A325 | 25.3 | 14.3 | 12.7 | 14.0 | 6.9 | 6.2 |
| CYMEL 303 | 4.3 | 0.6 | 0.6 | 2.0 | 1.0 | 0.9 |
| WITCOBOND 240 | 0.0 | 0.0 | 12.7 | 4.1 | 2.0 | 1.8 |
| JONCRYL 540 | 0.0 | 0.0 | 0.0 | 0.0 | 50.6 | 45.5 |
| Binder subtotal | 29.6 | 14.9 | 26.0 | 20.1 | 60.5 | 54.4 |
| BONJETCW-1 | 53.1 | 69.6 | 60.2 | 69.0 | 34.0 | 40.7 |
| TRITON X100 | 2.0 | 6.7 | 6.0 | 2.4 | 1.2 | 1.1 |
| NACURE 2530 | 15.4 | 8.7 | 7.8 | 8.6 | 4.2 | 3.8 |
| TOTAL | 100.0 | 99.9 | 100. | 100.1 | 99.9 | 100 |

CYMEL 303 is a hexamethoxymethylmelamine crosslinking agent supplied by Cytec Industries, Inc. BONJET CW-1 is a tradename for a self-crosslinking polyurethane dispersion of approximately 100 nm carbon particles that have a high active hydrogen content that is supplied by Orient Chemical. NACURE 2530 is an amine-blocked p-toluenesulfonic acid catalyst in an isopropand /methanol blend supplied by King Industries, Inc. JONCRYL 540 is a trademark for acrylic latex polymers supplied by S. C. Johnson, Racine, Wis. JONCRYL 540 has an acid number of 49 and a hydroxyl number 42. The above six compositions are on a dry weight basis. These compositions were coated at the % solids described below after adding water and 2-butoxythenol to provide an overall solvent system of about 95% by weight of water and 5% by weight of a solvent blend of 2-butoxyethanol, isopropanol, and methanol. Dissolution of the polymers in the solvent system, mixing of the ingredients, and coating application were done utilizing methods known in the art for these types of materials and coating formulations.

The infrared-absorbing layer of Example 2A was applied to the hydrophilic barrier coated aluminum substrate as a 4% solids fluid using a #4 Meyer wire wound rod on a production coating machine and dried at 145° C. for two minutes. When exposed on a Creo TRENDSETTER 1.7X laser imaging unit at 100 RPM and 14 watts (400 mj/cm$^2$ exposure energy), significant ablation occurred as evidenced by the reduced density in the laser-exposed areas, the high level of odor emanating from the surface, and the easily detected loose debris seen when wiped with a dry finger. At this laser exposure level, the plate did not completely clean up when scrubbed by water using a series of molleton rolls. By increasing the laser exposure level by exposing the plate at 65 RPM and 14 watts (610 mj/cm$^2$ exposure energy), the plate of Example 2A did completely clean up, but there was increased ablation as particularly evidenced by the increased level of loose debris that could be wiped off with a dry finger.

The infrared-absorbing layer of Examples 2B, 2C, and 2D had less polyvinyl alcohol binder and more water-dispersible black than the infrared-absorbing layer of Example 2A. Examples 2B, 2C, and 2D were coated at 1.6, 2.0 and 2.5% solids, respectively. All three of these infrared-absorbing coatings were applied to the hydrophilic layer utilizing a #4 Meyer wire wound rod and dried at 145° C. for two minutes. These all cleaned up well with water when imaged on the CREO laser-imaging unit at various faster imaging speeds than that used with Example 2A. The imaging speeds used were 40 to 100% faster than used with Example 2A. In contrast to Example 2A which showed significant ablation of at least 40% of the infrared-absorbing layer when imaged at 100 RPM and 14 watts, Examples 2B, 2C, and 2D over the range of coating weights evaluated showed less than 10% ablation of the infrared-absorbing layer when imaged over the 140 to 200 RPM and 14 watts range (200 to 280 mj/cm$^2$ exposure energy), and still exhibited excellent cleanability with water for completely removing the laser-exposed areas to provide a wet lithographic plate with excellent image resolution and fair durability.

The durability of Example 2D was improved from fair to good by drying and curing the infrared-absorbing layer at 175° C. for two minutes instead of at 145° C. for two minutes. Similar to observations in Example 1, the drying and curing conditions for the infrared-absorbing coating layer may have a significant effect on the overall quality of the lithographic printing member, particularly its ease of cleaning, image resolution, and durability on the press. Generally, these drying and curing conditions and the degree of curing of each coating layer at each stage of the process of preparing the lithographic printing member are determined by experimentation and chosen so as to optimize the overall quality. Also, after laser exposure and cleaning to remove the laser-exposed areas, the printing member may be further heated to increase the durability on the press. The durability on the press was estimated by wet rub resistance testing. Wet rub resistance is evaluated by measuring the finest lines or dots on the plate that survive 50 wet rubs with a WEBRIL cloth, a trademark for a lint-free cloth available from Veratec Corporation, Walpole, Mass., which has been wet with water. The wet rubs each involve a double pass back and forth across the imaged areas so that 50 wet rubs in the wet rub resistance tests of this invention actually involve a total of 100 passes or wet rubs across the imaged area. The wet rub resistance testing is also done with a WEBRIL cloth which has been wet with methyl ethyl ketone.

In the resolution and wet rub resistance testing of this invention, the image areas are of two types: (1) narrow lines in the form of a series of pixels with the width of the lines based on the number of pixels comprising the width, and (2) half tone dots at 150 lines per inch (lpi) halftone screen imaging. Approximate sizes of these image areas are as follows. One pixel lines are 15 microns wide, and 3 pixel lines are 40 microns wide. 2% Dots are 15 microns in diameter, 3% dots are 20 microns in diameter, 4% dots are 25 microns in diameter, 5% dots are 35 microns in diameter, and 10% dots are 60 microns in diameter. The smaller the widths of the pixel lines and the smaller the diameters of the dot sizes that can be achieved and maintained on the plate are the better for printing quality and press run length with acceptable quality. Thus, achieving a 1 pixel wide line image after cleaning and maintaining the 1 pixel wide line image through the wet rub resistance test is the best result for printing quality. Similarly, achieving a 2% dot image or a dot that is about 15 microns in diameter after cleaning and maintaining the 2% dot image through the wet rub resistance test is an excellent result for printing quality, and much more desirable compared to maintaining only 5% or 10% dots as the best dot images.

The image resolution was measured as the finest lines or dots of image or ink-acceptable areas that are achieved on the plate after the laser imaging exposure and subsequent cleaning steps.

The weight loss in the metal plate from laser ablation imaging is difficult to measure quantitatively, but may be estimated by comparison to calibrated standards from the same coatings on a plastic substrate, such as polyethylene terephthalate film, measured on a high precision analytical balance before and after laser exposure.

The infrared-absorbing layer of Examples 2E and 2F were coated over a range of lower and similar coating weights compared to the infrared-absorbing layer of Example 2A. Example 2E was coated at 4.8% solids, and Example 2F was coated at both 2.6% and 5.2% solids. All of these coatings were applied using a #4 Meyer wire wound rod. In order to increase the image resolution and durability of the imaged plate, coatings 2E and 2F were dried and cured at 175° C. for two minutes. In spite of the increased amount of binder present and the lower amount of water-dispersible carbon black present, Examples 2E and 2F cleaned up well with water after imaging on the Creo laser imaging unit over a range of 120 to 160 RPM and 14 watts (250 to 330 mj/cm$^2$ exposure energy). Before cleaning with water, these plates showed less than 10% ablation of the infrared-absorbing layer and, after cleaning, showed excellent wet lithographic plate properties, particularly excellent image resolution and excellent durability.

Substituting JONCRYL 138, which has no hydroxyl content and an acid number of 60, for the JONCRYL 540 in Example 2F at 5.2% solids, resulted in similar but not quite as good performance as found with Example 2F.

These results show the flexibility possible for the infrared-absorbing layer formulations and processing conditions of the non-ablative, extra high imaging speed, and easily cleaned wet lithographic printing members and methods of the present invention.

When imaged on the Creo laser imaging unit at the laser exposure conditions described above, in addition to the visible ablative weight loss of the infrared-absorbing layer, Example 2A, the comparative laser-ablative example, had considerable weakly bound debris in the laser-exposed areas which could be removed by a dry rub with a finger or a cloth and also had a strong odor when evaluated after removing it from the laser imaging unit right after the laser exposure. In contrast, Examples 2B to 2F had little or no weakly bound debris that could be removed by a dry rub with a finger or a cloth and also had no strong odor at any time during or after the laser exposure when imaged as described above.

If the laser exposure dwell time on Examples 2B to 2F is increased significantly on the Creo laser imaging unit, such as to an exposure at 65 RPM to 85 RPM and 14 watts (470 to 610 mj/cm$^2$ exposure energy), they will show ablation of more than 20% of the infrared-absorbing layer together with the development of some odor and a moderate amount of weakly bound debris in the laser-exposed area. Thus, some plates with the infrared-absorbing and other coating layers of the printing members of this invention may typically also be imaged by laser ablation imaging for use as wet lithographic plates. However, this alternative is not commercially attractive compared to the much higher imaging speed and non-ablative imaging process with no or extremely low airborne effluents and excellent cleanability and image quality of the methods of the present invention.

Example 3

A three layer lithographic printing plate in accordance with the invention, as illustrated in FIG. 4, was prepared by applying an ink accepting layer of the following composition on a dry weight basis to an Example 2D plate.

| Ink Accepting Surface Layer Composition | |
|---|---|
| 6 sec Nitrocellulose polymer | 1.94 |
| CYMEL 303 | 0.74 |
| NACURE 2530 (as PTSA) | 0.35 |

The 6 second Nitrocellulose was obtained from Aldrich Chemical Company as 70% blend with isopropanol.

The above components were mixed with 1-methoxy-2-propanol to give a 3% solids solution. An Example 2D plate was coated with this solution using a #3 wire wound rod and dried in a hot air oven for one minute at 175° F.

This three layer plate was exposed on a Creo TRENDSETTER 1.7X at 140 RPM and 14 watts (exposure of 280 mj/cm$^2$) with a GATF test image. Very little odor was detected coming from the plate surface and the image in the laser-exposed areas was only weakly visible with very slight loose debris seen when wiped with a dry finger. The exposed plate was easily cleaned by scrubbing with water using a series of molleton rolls.

The non-image background areas showed no residual infrared-absorbing coating and very fine highlight features were visible. The image areas had excellent durability. Two percent 150 lpi halftone dots and 0.05 point lines were fully retained after 50 vigorous double rubs with a water wet WEBRIL, and solid areas showed negligible change after 50 vigorous double rubs with a water wet WEBRIL wipe or 50 vigorous double rubs with a methyl ethyl ketone wet WEBRIL wipe. Water beaded up on image areas.

While the invention has been described in detail and with reference to specific and general embodiments thereof, it will be apparent to one skilled in the art that various changes and modifications can be made therein without departing from the spirit and scope thereof.

What is claimed is:

1. A method of imaging a wet positive-working lithographic printing member, said method comprising the steps of:

(a) providing a positive-working lithographic printing member, said member comprising a substrate, a hydrophilic layer overlying said substrate, an infrared-absorbing layer overlying said hydrophilic layer, and an ink-accepting surface layer overlying said infrared-absorbing layer; wherein (i) said surface layer is characterized by the absence of ablation from absorption of infrared imaging radiation; (ii) said infrared-absorbing layer is characterized by absorption of infrared imaging radiation; (iii) said surface and infrared-absorbing layers are characterized by being unremovable by cleaning with water or a cleaning solution prior to said absorption of infrared imaging radiation and by being adapted to form a wet lithographic printing surface as a result of an imagewise exposure to absorbable infrared radiation and subsequent removal of the exposed areas of said surface and infrared-absorbing layers by cleaning with water or said cleaning solution to reveal the underlying hydrophilic layer; and (iv) said hydrophilic layer is characterized by being unremovable by cleaning with water or said cleaning solution;

(b) exposing, in an imagewise pattern, said member to absorbable infrared radiation to effect absorption thereof by said infrared-absorbing layer, thereby causing said surface and infrared-absorbing layers in said laser-exposed areas to become removable by cleaning with water or said cleaning solution but without significant ablation of either the surface layer or the infrared-absorbing layer; and (c) removing, with water or said cleaning solution, said laser-exposed areas of said surface and infrared-absorbing layers to reveal the underlying hydrophilic layer.

2. The method of claim 1, wherein said surface layer comprises a crosslinked, polymeric reaction product of a polymer and a crosslinking agent.

3. The method of claim 2, wherein said polymer of said crosslinked, polymeric reaction product is selected from the group consisting of:

cellulosics; acrylic polymers; polyurethanes; and epoxy polymers.

4. The method of claim 2, wherein said surface layer comprises an organic sulfonic acid component.

5. The method of claim 1, wherein the weight of said surface layer is from 0.05 to 0.5 $g/m^2$.

6. The method of claim 1, wherein the weight of said surface layer is from 0.1 to 0.3 $g/m^2$.

7. The method of claim 1, wherein said hydrophilic layer is characterized by the absence of removal of said hydrophilic layer in said laser-exposed areas during steps (b) and (c).

8. The method of claim 1, wherein said absorption of infrared radiation in the laser-exposed areas of said infrared-absorbing layer of step (b) is insufficient to remove by ablation greater than 10% by weight of the combined surface layer and infrared-absorbing layer in said laser-exposed areas.

9. The method of claim 1, wherein said absorption of infrared radiation in the laser-exposed areas of said infrared-absorbing layer of step (b) is insufficient to remove by ablation greater than 2% by weight of the combined surface layer and infrared-absorbing layer in said laser-exposed areas.

10. The method of claim 1, wherein said absorption of infrared radiation in the laser-exposed areas of said infrared-absorbing layer of step (b) is insufficient to remove by ablation any of the surface layer and infrared-absorbing layer in said laser-exposed areas.

11. A method of preparing a wet lithographic printing member, said method comprising the steps of:

(a) coating onto a substrate a liquid mixture comprising a first liquid medium, a hydrophilic polymer, and a first crosslinking agent;

(b) drying the layer formed in step (a) to remove said first liquid medium and to form a hydrophilic layer;

(c) coating onto said hydrophilic layer a liquid mixture comprising a second liquid medium, a polymer, an infrared-absorbing sensitizer, and a second crosslinking agent;

(d) drying the layer formed in step (c) to remove said second liquid medium and to form an infrared-absorbing layer;

(e) coating onto said infrared-absorbing layer a liquid mixture comprising a third liquid medium and an ink-accepting polymer;

(f) drying the layer formed in step (e) to remove said third liquid medium and to form an ink-accepting surface layer; thereby forming a positive-working lithographic printing member, said surface layer, said infrared-absorbing layer, and said hydrophilic layer being unremovable by cleaning with water or a cleaning solution prior to exposure to absorbable infrared radiation;

(g) exposing, in an imagewise pattern, said member to absorbable infrared radiation to effect absorption by said infrared-absorbing layer, thereby causing said surface and infrared-absorbing layers in said laser-exposed areas to become removable by cleaning with water or said cleaning solution but without significant ablation of either the surface layer or the infrared-absorbing layer; and (h) removing, with water or said cleaning solution, said laser-exposed areas of said surface and infrared-absorbing layers to reveal the underlying hydrophilic layer.

12. The method of claim 11 wherein drying of the layer formed in step (a) causes a portion of the first crosslinking agent to react, and further wherein drying of the layer formed in step (c) causes an additional portion of said first crosslinking agent present in said hydrophilic layer to react and causes a portion of the second crosslinking agent present to react.

13. The method of claim 11 wherein a portion of said second crosslinking agent penetrates into said hydrophilic layer and wherein the step of drying the layer formed in step (c) further comprises drying the underlying hydrophilic layer.

14. A method of imaging a wet positive-working lithographic printing member, said method comprising the steps of:

(a) providing a positive-working lithographic printing member, said positive working member comprising a substrate, a hydrophilic layer overlying said substrate, an infrared-absorbing layer overlying said hydrophilic layer, an ink-accepting surface layer overlying said infrared-absorbing layer, and a primer layer interposed between said hydrophilic layer and said infrared-absorbing layer; wherein (i) said surface layer is characterized by the absence of ablation from absorption of infrared imaging radiation; (ii) said infrared-absorbing layer is characterized by absorption of infrared imaging radiation; (iii) said surface and infrared-absorbing layers are characterized by being unremovable by cleaning with water or a cleaning solution prior to said absorption of infrared imaging radiation and by being adapted to form a wet lithographic printing surface as a result of an imagewise exposure to absorbable infrared radiation and subsequent removal of the exposed areas of said surface and infrared-absorbing layers by cleaning with water or said cleaning solution to reveal the underlying hydrophilic layer; (iv) said primer layer comprises an adhesion-promoting agent; and (v) said hydrophilic layer is characterized by being not removable by cleaning with water or said cleaning solution;

(b) exposing, in an imagewise pattern, said member of step (a) to absorbable infrared radiation to effect absorption thereof by said infrared-absorbing layer, thereby causing said surface, infrared-absorbing and primer layers in said laser-exposed areas to become removable by cleaning with water or said cleaning solution but without significant ablation of either the surface layer or the infrared-absorbing layer; and (c) removing, with water or said cleaning solution, said laser-exposed areas of said surface, infrared-absorbing and primer layers to reveal the underlying hydrophilic layer.

15. The method of claim 14, wherein the thickness of said primer layer of step (a) is from 0.01 to 0.1 microns.

16. The method of claim 14, wherein said adhesion-promoting agent comprises a crosslinked, polymeric reaction product of a hydrophilic polymer and a crosslinking agent.

17. The method of claim 16, wherein said primer layer further comprises a catalyst.

18. The method of claim 14, wherein said primer layer comprises an organic sulfonic acid component.

19. The method of claim 14, wherein said primer layer comprises a zirconium compound.

20. The method of claim 14, wherein said hydrophilic layer is characterized by the absence of removal of said hydrophilic layer in said laser-exposed areas during steps (b) and (c).

21. The method of claim 14, wherein said absorption of infrared radiation in the laser-exposed areas of said surface layer of step (b) is insufficient to remove by ablation greater than 10% by weight of the surface layer in said laser-exposed areas.

22. The method of claim 14, wherein said absorption of infrared radiation in the laser-exposed areas of said surface layer of step (b) is insufficient to remove by ablation greater than 2% by weight of the surface layer in said laser-exposed areas.

23. The method of claim 14, wherein said absorption of infrared radiation in the laser-exposed areas of said surface layer of step (b) is insufficient to remove by ablation any of the surface layer in said laser-exposed areas.

24. A method of preparing a wet lithographic printing member, said method comprising the steps of:

(a) coating onto a substrate a liquid mixture comprising a first liquid medium, a hydrophilic polymer, and a first crosslinking agent;

(b) drying the layer formed in step (a) to remove said first liquid medium, to cause a portion of said first crosslinking agent present to react, and to form a hydrophilic layer;

(c) coating onto said hydrophilic layer a liquid mixture comprising a second liquid medium and an adhesion-promoting agent;

(d) drying the layer formed in step (c) to remove said second liquid medium and to form a primer layer;

(e) coating onto said primer layer a liquid mixture comprising a third liquid medium, a polymer, an infrared-absorbing sensitizer, and a second crosslinking agent;

(f) drying the layer formed in step (e) to remove said third liquid medium, to cause an additional portion of said first crosslinking agent present in said hydrophilic layer to react, to cause a portion of said second crosslinking agent present to react, and to form an infrared-absorbing layer;

(g) coating onto said infrared-absorbing layer a liquid mixture comprising a fourth liquid medium and an ink-accepting polymer;

(h) drying the layer formed in step (g) to remove said fourth liquid medium and to form an ink-accepting surface layer; thereby forming a positive-working lithographic printing member, wherein said surface layer, said infrared-absorbing layer, and said hydrophilic layer are characterized by being not removable by cleaning with water or a cleaning solution;

(i) exposing said member of step (h) to absorbable infrared radiation using an infrared-emitting laser to effect absorption of infrared radiation in the laser-exposed areas of said infrared-absorbing layer that is sufficient to cause said surface, infrared-absorbing and primer layers in said laser-exposed areas to become removable by cleaning with water or said cleaning solution but insufficient to remove by ablation greater than 10% by weight of the combined surface layer and infrared-absorbing layer in said laser-exposed areas; and (j) removing, with water or said cleaning solution, said laser-exposed areas of said surface, infrared-absorbing and primer layers to reveal the underlying hydrophilic layer.

25. A method of preparing a wet lithographic printing member, said method comprising the steps of:

(a) coating onto a substrate a liquid mixture comprising a first liquid medium, a hydrophilic polymer, and a first crosslinking agent;

(b) drying the layer formed in step (a) to remove said first liquid medium and to form a hydrophilic layer;

(c) coating onto said hydrophilic layer a liquid mixture comprising a second liquid medium and an adhesion-promoting agent;

(d) drying the layer formed in step (c) to remove said second liquid medium and to form a primer layer;

(e) coating onto said primer layer a liquid mixture comprising a third liquid medium, a polymer, an infrared-absorbing sensitizer, and a second crosslinking agent; wherein a portion of said second crosslinking agent penetrates into said hydrophilic layer;

(f) drying the layer formed in step (e) and the underlying primer and hydrophilic layers to remove said third liquid medium, to cause a portion of said second crosslinking agent present in said hydrophilic layer to react, and to form an infrared-absorbing layer;

(g) coating onto said infrared-absorbing layer a liquid mixture comprising a fourth liquid medium and an ink-accepting polymer;

(h) drying the layer formed in step (g) to remove said fourth liquid medium and to form an ink-accepting surface layer; thereby forming a positive-working lithographic printing member, wherein said surface layer, said infrared-absorbing layer, and said hydrophilic layer are characterized by being not removable by cleaning with water or a cleaning solution;

(i) exposing said member of step (h) to absorbable infrared radiation using an infrared-emitting laser to effect absorption of infrared radiation in the laser-exposed areas of said infrared-absorbing layer that is sufficient to cause said surface, infrared-absorbing and primer layers in said laser-exposed areas to become removable by cleaning with water or said cleaning solution but insufficient to remove by ablation greater than 10% by weight of the combined surface layer and infrared-absorbing layer in said laser-exposed areas; and (j) removing, with water or said cleaning solution, said laser-exposed areas of said surface, infrared-absorbing and primer layers to reveal the underlying hydrophilic layer.

* * * * *